US010870548B2

(12) United States Patent
Hori et al.

(10) Patent No.: US 10,870,548 B2
(45) Date of Patent: Dec. 22, 2020

(54) MEDIUM SUPPLY APPARATUS

(71) Applicant: RISO KAGAKU CORPORATION, Tokyo (JP)

(72) Inventors: Eiji Hori, Tsukuba (JP); Yoshihisa Morita, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/816,800

(22) Filed: Mar. 12, 2020

(65) Prior Publication Data

US 2020/0307931 A1 Oct. 1, 2020

(30) Foreign Application Priority Data

Mar. 26, 2019 (JP) ..... 2019-057655
Jan. 29, 2020 (JP) ..... 2020-012650

(51) Int. Cl.
*B65H 3/12* (2006.01)
*B65H 3/46* (2006.01)

(52) U.S. Cl.
CPC ..... *B65H 3/46* (2013.01); *B65H 3/128* (2013.01)

(58) Field of Classification Search
CPC ..... B65H 3/08; B65H 3/0816; B65H 3/12; B65H 3/124; B65H 3/128; B65H 3/46
See application file for complete search history.

(56) References Cited

U.S. PATENT DOCUMENTS 7,537,208 B2 * 5/2009 Fukusaka ..... B65H 3/128 271/94
7,931,264 B2 * 4/2011 Shibuya ..... B65H 3/128 271/9.02
7,976,011 B2 * 7/2011 Shibuya ..... B65H 3/06 271/9.02
2007/0296136 A1 * 12/2007 Fukusaka ..... B65H 3/128 271/11
2013/0134651 A1 * 5/2013 Kannari ..... B65H 7/20 271/105

FOREIGN PATENT DOCUMENTS

JP 5163425 B2 3/2013

* cited by examiner

*Primary Examiner* — Thomas A Morrison
(74) *Attorney, Agent, or Firm* — Greenblum & Bernstein, P.L.C.

(57) ABSTRACT

A medium supply apparatus includes: a placement mount on which a plurality of media are placed; a transportation mechanism that transports an uppermost medium of the plurality of media placed on the placement mount; and an aspiration mechanism that aspirates air to attract the uppermost medium to the transportation mechanism, wherein the aspiration mechanism includes a blocking means for blocking air aspiration performed by the aspiration mechanism, in such a manner as to prevent another medium of the plurality of media that is located below the uppermost medium from being attracted to the transportation mechanism.

9 Claims, 16 Drawing Sheets

MEDIUM SUPPLY APPARATUS

CROSS-REFERENCE TO RELATED APPLICATION

This application is based upon and claims the benefit of priority of the prior Japanese Patent Application No. 2019-057655, filed on Mar. 26, 2019, the entire contents of which are incorporated herein by reference, and this application is based upon and claims the benefit of priority of the prior Japanese Patent Application No. 2020-012650, filed on Jan. 29, 2020.

FIELD

The aspects described herein are related to a medium supply apparatus.

BACKGROUND

As a paper feeding apparatus for supplying sheets, i.e., exemplary media, to a printing unit or the like of a printing apparatus, a conventional paper feeding apparatus is known that includes a placement mount on which a plurality of sheets are placed, a transportation mechanism that transports an uppermost sheet of the plurality of sheets placed on the placement mount, and an aspiration mechanism that aspirates air to attract the uppermost sheet to the transportation mechanism.

A paper feeding apparatus has also been proposed wherein a separating projection protruding from an attraction surface for attracting an uppermost sheet on a placement mount presses the uppermost sheet downward so as to form air layers between the uppermost sheet and the following sheet (second sheet), and separation air is blown to these air layers (e.g., Japanese Patent No. 5163425).

SUMMARY

In one aspect, a medium supply apparatus includes: a placement mount on which a plurality of media are placed; a transportation mechanism that transports an uppermost medium of the plurality of media placed on the placement mount; and an aspiration mechanism that aspirates air to attract the uppermost medium to the transportation mechanism, wherein the aspiration mechanism includes a blocking means for blocking air aspiration performed by the aspiration mechanism, in such a manner as to prevent another medium of the plurality of media that is located below the uppermost medium from being attracted to the transportation mechanism.

DESCRIPTION OF EMBODIMENTS

In the meantime, the separating projection is used as described above to form air layers on the front-edge side of the sheet in the transportation direction; and on the rear-edge side of the uppermost sheet in the transportation direction, the aspiration mechanism is exposed in association with the uppermost sheet being transported. Thus, the second sheet exposed upward in association with transportation of the uppermost sheet will be attracted to the aspiration mechanism and transported together with the uppermost sheet. Accordingly, a leading-edge portion of the second sheet in the transportation direction will be folded as in the reference art described in the following.

Figure 10:
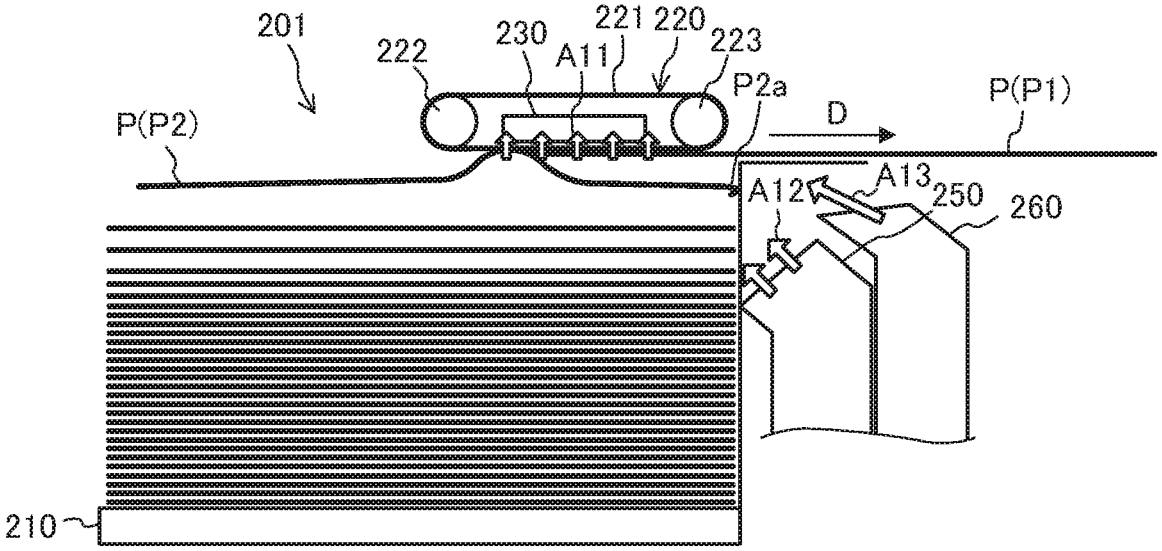
FIG. 10 is an explanatory diagram for a paper feeding operation in a reference art.

FIG. 10 is an explanatory diagram for a paper feeding operation in a reference art.

A paper feeding apparatus 201 depicted in FIG. 10 includes a placement mount 210, a transportation mechanism 220, an aspiration mechanism 230, a rising-air blowout mechanism 250, and a separation-air blowout mechanism 260.

A plurality of sheets P are placed on the placement mount 210.

The transportation mechanism 220 includes a transportation belt 221 and pulleys 222 and 223 covered therewith and transports an uppermost sheet P1 of the plurality of sheets P placed on the placement mount 210.

The aspiration mechanism 230 aspirates aspiration air A11 to attract the uppermost sheet P1 to the transportation belt 221.

The rising-air blowout mechanism 250 blows out rising air A12 for floating, for example, about ten of the plurality of sheets P placed on the placement mount 210.

The separation-air blowout mechanism 260 blows out separation air A13 for separating the uppermost sheet P1 and a second sheet P2 from each other.

The paper feeding apparatus 201 is such that a plurality of sheets P floats owing to the rising air A12 from the rising-air blowout mechanism 250 and the uppermost sheet P1 is then attracted to the transportation belt 221 by the aspiration air A11 provided by the aspiration mechanism 230.

The uppermost sheet P1 attracted to the transportation belt 221 is transported in a transportation direction D (transported to the right side with reference to FIG. 10) by the transportation belt 221. During the process of the uppermost sheet P1 being transported like this, the second sheet P2 is exposed upward in association with the transportation of the uppermost sheet P1 and attracted to the transportation belt 221 due to the aspiration by the aspiration air A11 provided by the aspiration mechanism 230. Thus, the second sheet P2 will be transported by the transportation belt 221 together with the uppermost sheet P1, and a leading edge of the second sheet P2 in the transportation direction D2 will knock against a wall surface of the placement mount 210, with the result that a folded paper-portion P2*a* will be made.

The following describes a paper feeding apparatus (an example of a medium supply apparatus) in accordance with embodiments of the present invention by referring to the drawings.

One Embodiment

Figure 1:
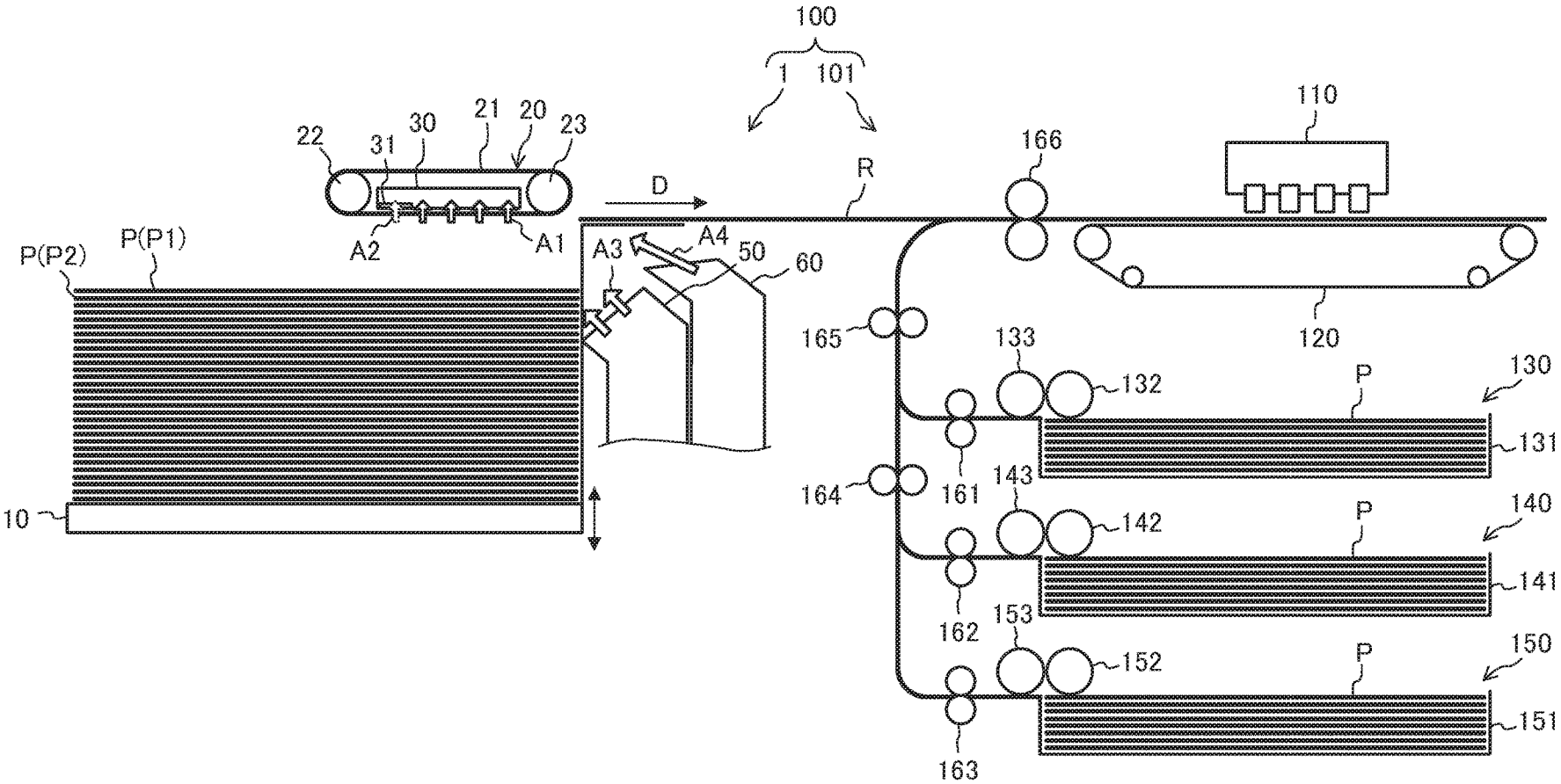
FIG. 1 is a configuration diagram illustrating a printing system that includes a paper feeding apparatus in accordance with one embodiment.

FIG. 1 is a configuration diagram illustrating a printing system 100 that includes a paper feeding apparatus 1 in accordance with one embodiment.

Figure 2:
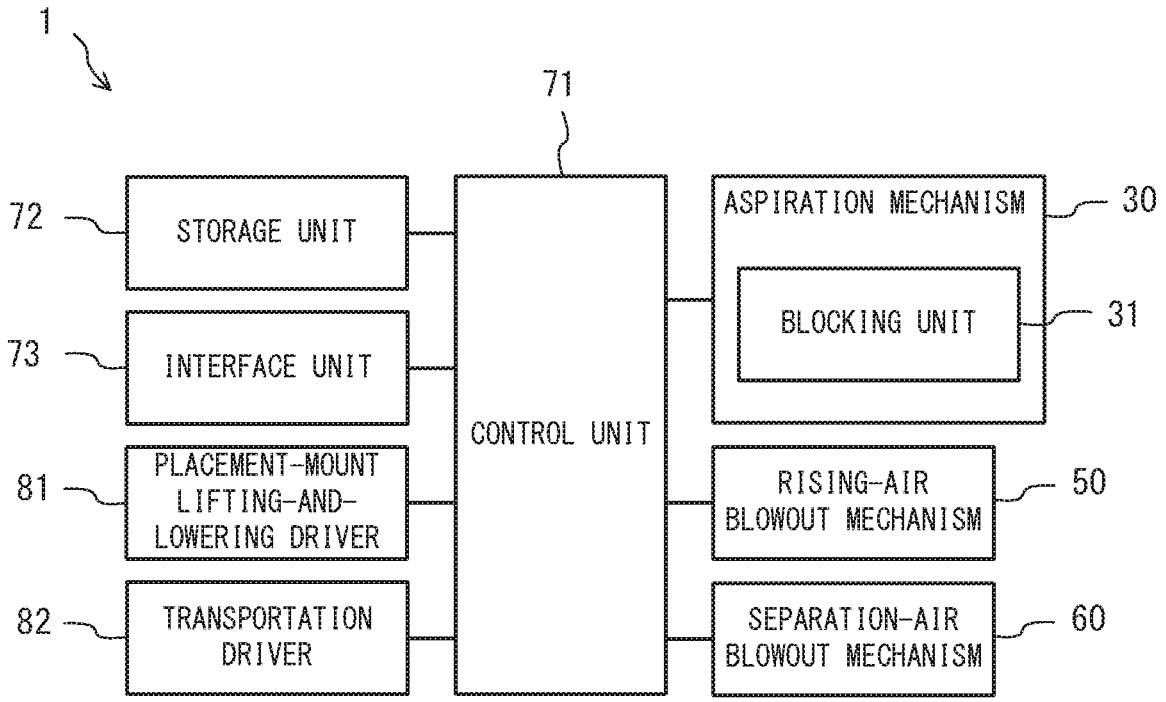
FIG. 2 illustrates the control configuration of a paper feeding apparatus in accordance with one embodiment.

FIG. 2 illustrates the control configuration of the paper feeding apparatus 1.

The printing system 100 depicted in FIG. 1 includes the paper feeding apparatus 1 and a printing apparatus 101.

The paper feeding apparatus 1 supplies a sheet P to a printing unit 110 of the printing apparatus 101. The paper feeding apparatus 1 may be integral with the printing apparatus 101. The paper feeding apparatus 1 may supply a sheet P to another apparatus such as a transportation apparatus, rather than to the printing apparatus 101. The sheet P is an example of a medium that may be a film. A plurality of paper feeding apparatuses 1 may be arranged in, for example, an up-down direction and supply sheets P to the single printing apparatus 101.

As depicted in FIG. 1, the paper feeding apparatus 1 includes a placement mount 10, a transportation mechanism 20, an aspiration mechanism 30, a rising-air blowout mechanism 50, and a separation-air blowout mechanism 60.

As depicted in FIG. 2, the paper feeding apparatus 1 includes a control unit 71, a storage unit 72, an interface unit 73, a placement-mount lifting-and-lowering driver 81, and a transportation driver 82.

A plurality of sheets P are placed on the placement mount 10 depicted in FIG. 1. The placement mount 10 is lifted or lowered through a driving operation performed by the placement-mount lifting-and-lowering driver 81 depicted in FIG. 2. As an example, the control unit 71 may control the placement-mount lifting-and-lowering driver 81 so as to lift the placement mount 10 when light emitted horizontally at a predetermined placement plane height by a light emission unit of a placement-surface sensor (not illustrated) is not blocked by the sheets P and is thus received by a light reception unit of the placement-surface sensor. Consequently, the uppermost sheet P1 is maintained at the predetermined placement-surface height.

The transportation mechanism 20 includes a transportation belt 21 and pulleys 22 and 23 covered therewith. One of the pulleys 22 and 23 is a drive pulley, and the other is a driven pulley. The drive pulley rotates through a driving operation performed by the transportation driver 82 depicted in FIG. 2, thereby rotating the transportation belt 21. Accordingly, the transportation mechanism 20 transports the uppermost sheet P1 in a transportation direction D (transports to the right side with reference to FIG. 1).

The transportation belt 21 includes a plurality of through holes through which aspiration airs A1 and an aspiration air A2 aspirated by the aspiration mechanism 30 (this mechanism will be described hereinafter) are to pass. Among the aspiration airs aspirated by the aspiration mechanism 30, the aspiration air A2 is located on an upstream side in the transportation direction D, and the other aspiration airs are the aspiration airs A1. In FIGS. 1, 3, 5A-5C, 6A-6D, 8A-8D, and 9, dashed arrows indicate aspiration airs A2 with aspiration blocked at least partially, and sold arrows indicate aspiration airs A2 without aspiration blocked at all.

As an example, a plurality of (e.g., two) transportation mechanisms 20 may be arranged in a width direction of a sheet P that is orthogonal to the transportation direction D of the sheet P, in a manner such that, while the sheet P is being transported, these mechanisms are located at a center of the sheet P in the width direction. In this case, the aspiration mechanism 30 (described hereinafter) may be provided for each individual transportation mechanism 20. Of course, only a single transportation mechanism 20 may be provided.

The transportation mechanism 20 may include another transportation member such as a transportation roller, instead of the transportation belt 21. When the transportation mechanism 20 includes a transportation roller, the transportation driver 82 will rotate the driving roller (transportation roller), not the drive pulley.

Figure 3:
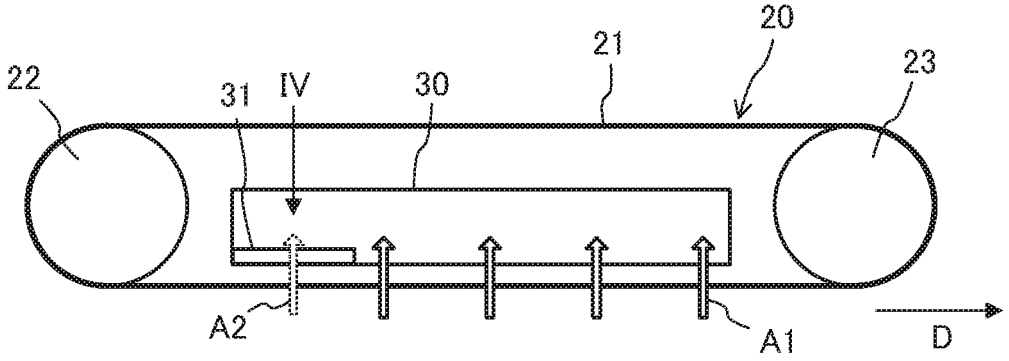
FIG. 3 is an enlarged view illustrating a transportation mechanism and an aspiration mechanism in one embodiment.

For example, the aspiration mechanism 30 depicted in an enlarged manner in FIG. 3 may be disposed in a region surrounded by the transportation belt 21 of the transportation mechanism 20. The aspiration mechanism 30 is such that an aspirator (not illustrated) (e.g., an aspiration fan) aspirates the aspiration airs A1 and A2 through the plurality of through holes provided in the transportation belt 21, thereby allowing the uppermost sheet P1 of the plurality of sheets P placed on the placement mount 10 to be attracted to the transportation mechanism 20.

The aspiration mechanism 30 includes a blocking unit 31 for blocking aspiration of the aspiration air A2 for a portion (only a portion) of the aspiration member 30 located on the upstream side in the transportation direction D. The blocking unit 31 is an example of the blocking means. For example, the blocking unit 31 may be disposed on an inner bottom surface of the aspiration mechanism 30 (inside a chamber). Alternatively, the blocking unit 31 may be disposed on an outer bottom surface of the aspiration mechanism 30 (outside the chamber).

Figure 4A:
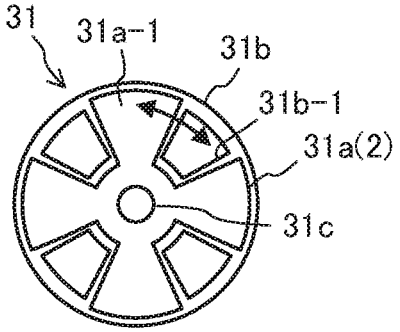
FIG. 4A illustrates a blocking unit in one embodiment as seen in a IV direction indicated in FIG. 3 (example 1)
Figure 4B:
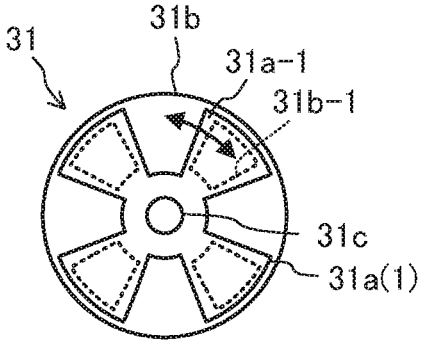
FIG. 4B illustrates a blocking unit in one embodiment as seen in a IV direction indicated in FIG. 3 (example 2)

FIGS. 4A and 4B are each a diagram (plan view) illustrating the blocking unit 31 as seen in a IV direction indicated in FIG. 3.

As depicted in FIG. 4A, the blocking unit 31 includes a shutter 31*a*, an opening member 31*b*, and a rotating shaft member 31*c*.

In accordance with a driving operation performed by a shutter driver (not illustrated) (e.g., an actuator such as a motor), the shutter 31*a* swings (rotates) clockwise or counterclockwise by, for example, 45° or less with the rotating shaft member 31*c* as a central axis of rotation.

For example, the shutter 31*a* may include four blades 31*a*-1. The four blades 31*a*-1 are arranged in a rotation direction of the shutter 31*a* at equal intervals (e.g., intervals of 90°).

For example, the opening member 31*b* may be a disk-shaped plate. The opening member 31*b* includes, for example, four through holes 31*b*-1 through which an aspiration air A2 aspirated by the aspiration mechanism 30 (this mechanism will be described hereinafter) is to pass. As with the blades 31*a*-1, the four through holes 31*b*-1 are arranged in the rotation direction of the shutter 31*a* at equal intervals (e.g., intervals of 90°).

The shutter 31*a* is such that the blades 31*a*-1 swing (move) to a blocking position (1) where, as depicted in FIG. 4B, the blades 31*a*-1 cover the through holes 31*b*-1 and thus block aspiration of the aspiration air A2 indicated in FIG. 3 or a retracted position (2), i.e., a position retracted from the blocking position (1), where, as depicted in FIG. 4A, the blades 31*a*-1 do not cover the through holes 31*b*-1 and thus do not block the aspiration of the aspiration air A2.

Portions of the opening member 31*b* that are not provided with the through holes 31*b*-1 will block aspiration of the aspiration air A2. However, as the blocking of aspiration of the aspiration air A2 that is achieved by the opening member 31*b* does not tend to affect a force attracting the sheet P, it may be considered that the aspiration of the aspiration air A2 is not blocked. The opening member 31*b* will not block the aspiration of the aspiration air A2 when through holes provided in the bottom surface of the aspiration mechanism 30 have the same shape as the through holes 31*b*-1 of the opening member 31*b* and overlap the through holes 31*b*-1 or when the opening member 31*b* is not provided and the shutter 31*a* moves to a blocking position where the shutter 31*a* covers through holes provided in the bottom surface of the aspiration mechanism 30 and a retracted position retracted from the blocking position.

Figure 5A:
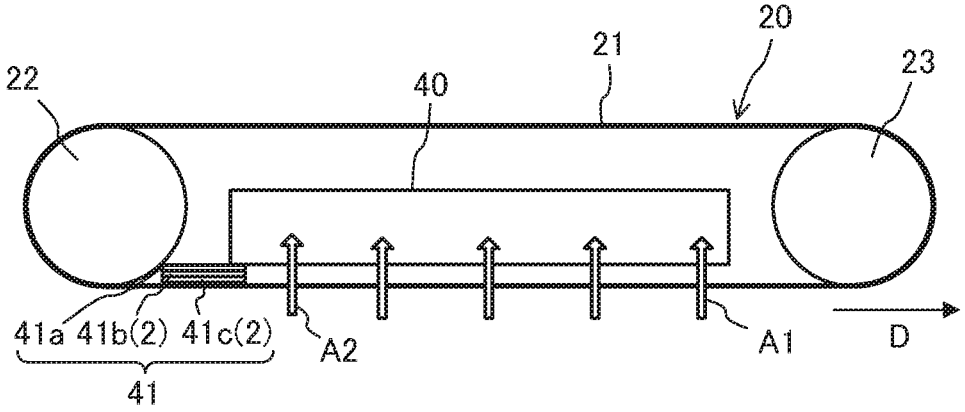
FIG. 5A is an enlarged view illustrating a transportation mechanism and an aspiration mechanism in a first variation of one embodiment (example 1)
Figure 5B:
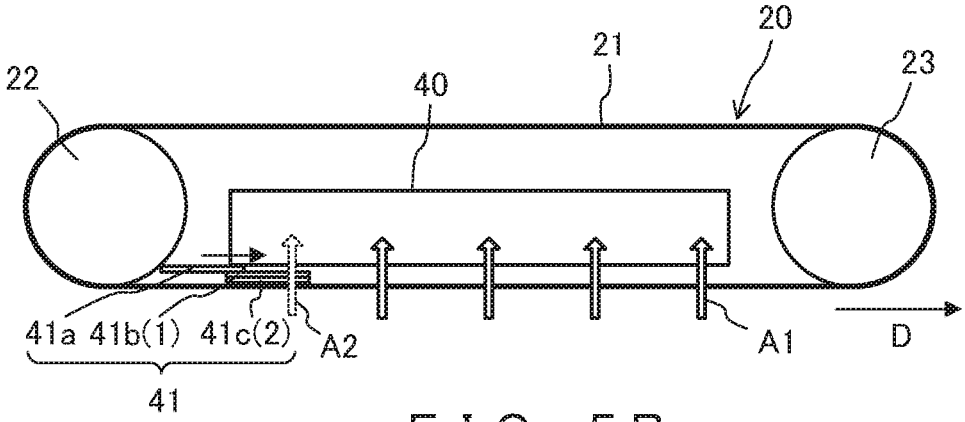
FIG. 5B is an enlarged view illustrating a transportation mechanism and an aspiration mechanism in a first variation of one embodiment (example 2)
Figure 5C:
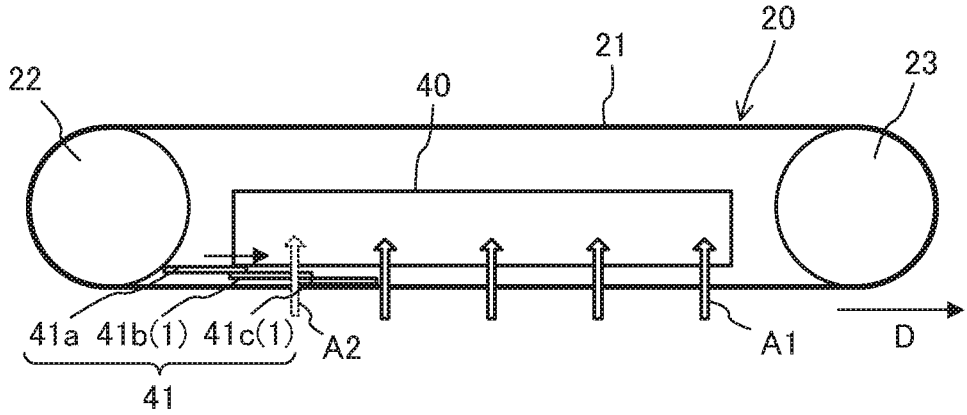
FIG. 5C is an enlarged view illustrating a transportation mechanism and an aspiration mechanism in a first variation of one embodiment (example 3)

FIGS. 5A-5C are each an enlarged view illustrating a transportation mechanism 20 and an aspiration mechanism 40 in a first variation.

The aspiration mechanism 40 depicted in FIGS. 5A-5C is different from the aspiration mechanism 30 (blocking unit 31) only in terms of the configuration of a blocking unit 41.

For example, the blocking unit 41 may be disposed on an outer bottom surface of the aspiration mechanism 40 (outside a chamber). Alternatively, the blocking unit 41 may be disposed on an inner bottom surface of the aspiration mechanism 40 (inside the chamber).

The blocking unit 41 includes a shutter support 41*a*, a first shutter 41*b*, and a second shutter 41*c*. The first shutter 41*b* and the second shutter 41*c* are examples of a plurality of shutters. For example, the first shutter 41*b* and the second shutter 41*c* may be plates disposed parallel to an attraction surface (bottom surface) of the transportation belt 21.

While being guided by the shutter support 41*a*, the first shutter 41*b* is moved through a driving operation performed by a shutter driver (not illustrated) (e.g., an actuator such as a motor) from a retracted position (2) depicted in FIG. 5A downstream in the transportation direction D to a blocking position (1) depicted in FIG. 5B. When the first shutter 41*b* is moved, the second shutter 41*c* is moved integrally with the first shutter 41*b*.

After the first shutter 41*b* is moved downstream in the transportation direction D to the utmost limit as depicted in FIG. 5B, while being guided by the first shutter 41*b*, the second shutter 41*c* is moved through a driving operation performed by a shutter driver (not illustrated) from a retracted position (2) depicted in FIG. 5B downstream in the transportation direction D to a blocking position (1) depicted in FIG. 5C.

As described above, the blocking unit 41 includes the first shutter 41*b* and the second shutter 41*c* which move to the blocking positions (see (1) in FIGS. 5B and 5C) where these shutters block the aspiration of the aspiration air A2 or the retracted positions (see (2) in FIG. 5A) retracted from the blocking position.

The blocking unit 41 is such that the area of blocking the aspiration of the aspiration air A2 is increased when the second shutter 41*c* is moved, relative to the first shutter 41*b*, downstream in the transportation direction D as depicted in FIG. 5C, in comparison to when the first shutter 41*b* and the second shutter 41*c* overlap each other as depicted in FIG. 5B. Accordingly, the first shutter 41*b* and the second shutter 41*c* located as indicated in FIG. 5A are integrally moved downstream in the transportation direction D as depicted in FIG. 5B, and then only the second shutter 41*c* is moved downstream in the transportation direction D as depicted in FIG. 5C, thereby controlling the positions of the first shutter 41*b* and the second shutter 41*c* in a manner such that the area of blocking the aspiration of the aspiration air A2 is increased toward the downstream side in the transportation direction D, i.e., the first shutter 41*b* and the second shutter 41*c* are considered to each be moved from the retracted position (2) to the blocking position (1). The control unit 71 may control the positions of the first shutter 41*b* and the second shutter 41*c* in a manner such that the area of blocking the aspiration of the aspiration air A2 is increased toward the downstream side in the transportation direction D in accordance with the transportation of the uppermost sheet P1. In a case where only a single shutter is provided, when this shutter is moved downstream in the transportation direction D, the position thereof is controlled in a manner such that in accordance with the transportation of the uppermost sheet P1, the area of blocking the aspiration of the aspiration air A2 is increased toward the downstream side in the transportation direction D, i.e., the shutter is considered to be moved from a retracted position to a blocking position.

Figure 6A:
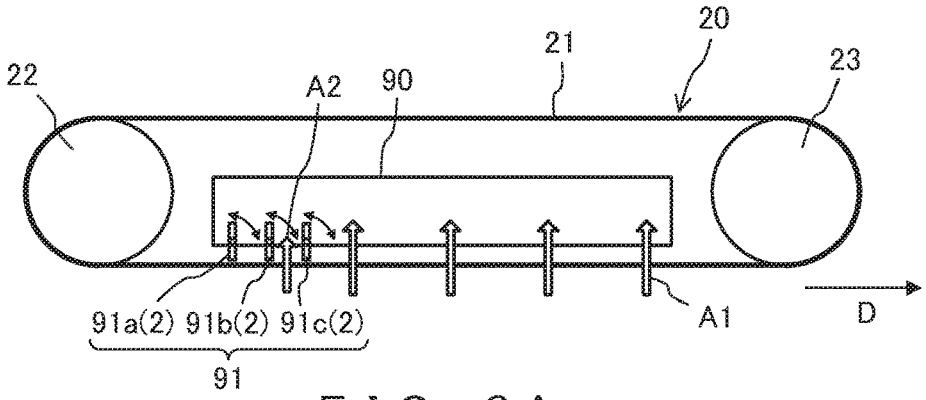
FIG. 6A is an enlarged view illustrating a transportation mechanism and an aspiration mechanism in a second variation of one embodiment (example 1)
Figure 6B:
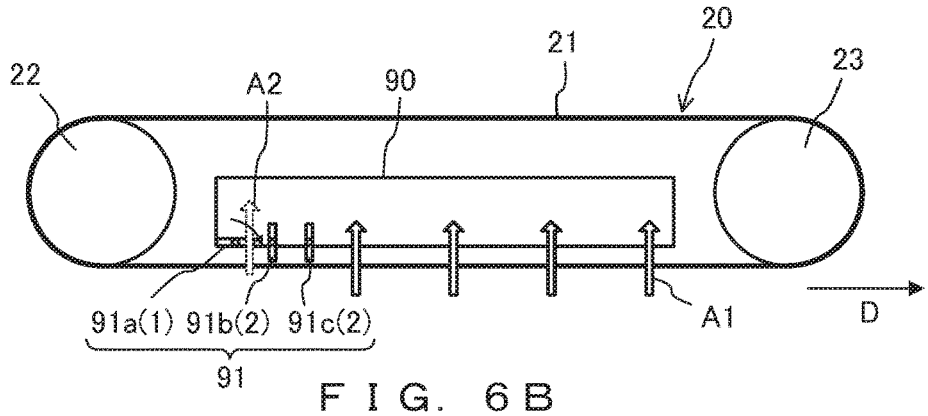
FIG. 6B is an enlarged view illustrating a transportation mechanism and an aspiration mechanism in a second variation of one embodiment (example 2)
Figure 6C:
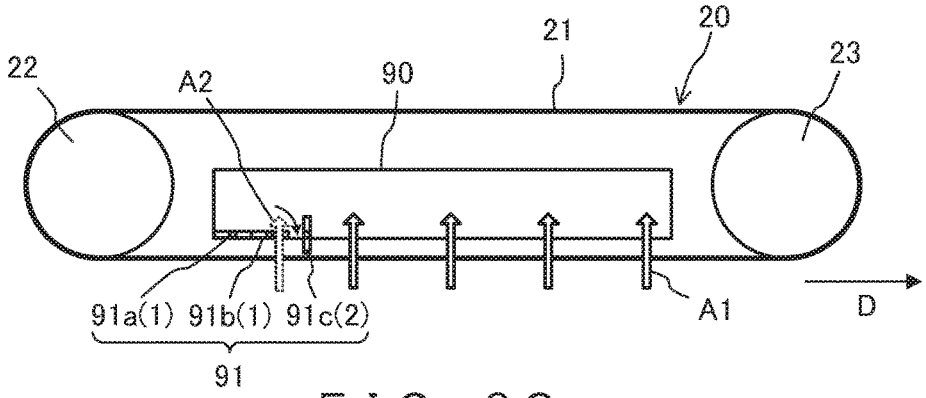
FIG. 6C is an enlarged view illustrating a transportation mechanism and an aspiration mechanism in a second variation of one embodiment (example 3)

FIGS. 6A-6C are each an enlarged view illustrating a transportation mechanism 20 and an aspiration mechanism 90 in a second variation.

The aspiration mechanism 90 depicted in FIGS. 6A-6C is different from the aspiration mechanism 30 (blocking unit 31) and the aspiration mechanism 40 (blocking unit 41) only in terms of the configuration of a blocking unit 91.

For example, the blocking unit 91 may be disposed on an outer bottom surface of the aspiration mechanism 90 (outside a chamber). Alternatively, the blocking unit 91 may be disposed on an inner bottom surface of the aspiration mechanism 90 (inside the chamber).

The blocking unit 91 includes a first shutter 91*a*, a second shutter 91*b*, and a third shutter 91*c*. The first shutter 91*a*, the second shutter 91*b*, and the third shutter 91*c* are examples of a plurality of shutters. For example, the first shutter 91*a*, the second shutter 91*b*, and the third shutter 91*c* may be plates located at blocking positions (1) depicted in FIG. 6D and disposed parallel to the attraction surface (bottom surface) of the transportation belt 21. The first shutter 91*a* is located upstream from the second shutter 91*b* in the transportation direction D and adjacent to the second shutter 91*b*. The second shutter 91*b* is located upstream from the third shutter 91*c* in the transportation direction D and adjacent to the third shutter 91*c*.

Figure 6D:
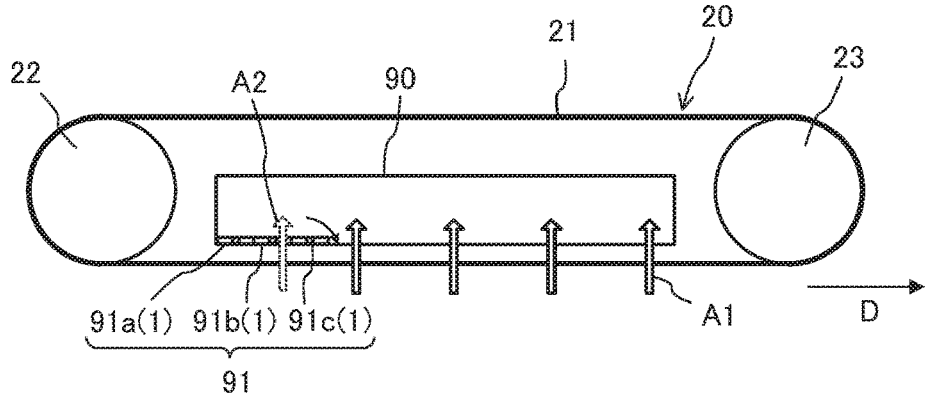
FIG. 6D is an enlarged view illustrating a transportation mechanism and an aspiration mechanism in a second variation of one embodiment (example 4)

In accordance with a driving operation performed by a shutter driver (not illustrated) (e.g., an actuator such as a motor), the first shutter 91*a*, the second shutter 91*b*, and the third shutter 91*c* rotate (move) to the retracted positions (2) depicted in FIG. 6A and the blocking positions (1) depicted in FIG. 6D on central axes of rotation extending in a width direction (the depth direction in FIGS. 6A-6D) of the sheet P that is orthogonal to the transportation direction D.

All of the first shutter 91*a*, the second shutter 91*b*, and the third shutter 91*c* may be concurrently rotated from the retracted positions (2) depicted in FIG. 6A to the blocking positions (1) depicted in FIG. 6D. Alternatively, the first shutter 91*a* may first be rotated from the retracted position (2) to the blocking position (1) as depicted in FIG. 6B, the second shutter 91*b* may then be rotated from the retracted position (2) to the blocking position (1) as depicted in FIG. 6C, and the third shutter 91*d* may finally be rotated from the retracted position (2) to the blocking position (1) as depicted in FIG. 6D.

As described above, the blocking unit 91 includes the first shutter 91*a*, the second shutter 91*b*, and the third shutter 91*c* which move to the blocking positions (see (1) in FIG. 6D and the like) where these shutters block the aspiration of the aspiration air A2 and the retracted positions (see (2) in FIG. 6A and the like) retracted from the blocking positions.

The blocking unit 91 is such that the area of blocking the aspiration of the aspiration air A2 is larger when the first shutter 91*a* and the second shutter 91*d* are located at the blocking positions (1) as depicted in FIG. 6C than when only the first shutter 91*a* is located at the first blocking position (1) as depicted in FIG. 6B. The area of blocking the aspiration of the aspiration air A2 is larger when all of the first shutter 91*a*, the second shutter 91*d*, and the third shutter 91*c* are located at the blocking positions (1) as depicted in FIG. 6D than when the first shutter 91*a* and the second shutter 91*b* are located at the blocking positions (1) as depicted in FIG. 6C. Accordingly, the blocking unit 91 is put in the state indicated in FIG. 6A, the state indicated in FIG. 6B, the state indicated in FIG. 6C, and the state indicated in FIG. 6D in this order, thereby controlling the positions of the first shutter 91*a*, the second shutter 91*b*, and the third shutter 91*c* in a manner such that the area of blocking the aspiration of the aspiration air A2 is increased toward the downstream side in the transportation direction D, i.e., the first shutter 91*a*, the second shutter 91*b*, and the third shutter 91*c* are considered to each be moved from the retracted positions (2) to the blocking positions (1). The control unit 71 may control the positions of the first shutter 91*a*, the second shutter 91*b*, and the third shutter 91*c* in a manner such that the area of blocking the aspiration of the aspiration air A2 is increased toward the downstream side in the transportation direction D in accordance with the transportation of the uppermost sheet P1.

Regarding the blocking unit of which position is, as in the first and second variations, controlled to increase the area of blocking the aspiration of the aspiration air A2 toward the downstream side in the transportation direction D and which is thus moved from the retracted position (2) to the blocking position (1), for example, a plurality of the above-described blocking units 31 depicted in FIG. 3 may be arranged in the transportation direction D, and these blocking units may block the aspiration of the aspiration air A in an order starting from the most upstream blocking unit 31 in the transportation direction D.

The blocking unit of which position is controlled to increase the area of blocking the aspiration of the aspiration air A2 toward the downstream side in the transportation direction D and which is thus moved from the retracted position to the blocking position may include a shutter that can be spooled and unspooled, wherein the blocking unit is moved to the blocking position for blocking the aspiration of the aspiration air A2 in accordance with the shutter being unspooled downstream in the transportation direction D and is moved to the retracted position retracted from the blocking position in accordance with the shutter being spooled upstream in the transportation direction D; and the configurations of the blocking units 31, 41, and 91 are not particularly limited. When the aspiration mechanism 30 includes a plurality of aspirators (e.g., aspiration fans), the blocking means, examples of which are the blocking units, may be a drive circuit or the like that stops the driving of aspirators that are located at portions of the aspiration mechanisms 30 on the upstream side in the transportation direction D and aspirate the aspiration air A2.

The rising-air blowout mechanism 50 depicted in FIG. 1 is located downstream in the transportation direction D from a plurality of sheets P placed on the placement mount 10 and blows out rising air A3 for floating, for example, about ten sheets P, including the uppermost sheet P.

The separation-air blowout mechanism 60 is located downstream in the transportation direction D from the plurality of sheets P placed on the placement mount 10 and blows out separation air A4 for separating the uppermost sheet P1 from a second sheet P2.

The control unit 71 depicted in FIG. 2 includes a processor (e.g., central processing unit (CPU)) for functioning as an arithmetic processing apparatus for controlling the operations of the entirety of the paper feeding apparatus 1 and controls the operations of components such as the blocking unit 31 (shutter driver). When, for example, the paper feeding apparatus 1 is integral with the printing apparatus 101, a control unit for the printing apparatus 101 may also serve as the control unit 71.

For example, the storage unit 72 may be a read only memory (ROM) that is a read-only semiconductor memory having a predetermined control program recorded therein in advance, or a random access memory (RAM) that is a randomly writable/readable semiconductor memory used as a working storage region on an as-needed basis when a processor executes various control programs.

The interface unit 73 communicates various information with external devices such as the control unit for the printing apparatus 101. For example, the interface unit 73 may receive information such as a paper-feeding request or a paper-feeding stop request from the control unit for the printing apparatus 101, and the control unit 71 may control the operations of various components of the paper feeding apparatus 1 on the basis of the information.

The placement-mount lifting-and-lowering driver 81 includes a motor (an example of an actuator) for lifting or lowering the placement mount 10.

The transportation driver 82 includes a motor (an example of an actuator) for rotating the drive pulley, i.e., either of the pulleys 22 and 23 of the transportation mechanism 20.

Next, descriptions will be given of the printing apparatus 101.

The printing apparatus 101 includes the printing unit 110, a transporter 120, a first paper feeder 130, a second paper feeder 140, a third paper feeder 150, transportation roller pairs 161-165, and a paper-stop-roller pair 166. Thick solid lines in FIG. 1 indicate a transportation path R from the paper feeding apparatus 1, the first paper feeder 130, the second paper feeder 140, and the third paper feeder 150 to the printing unit 110.

For example, the printing unit 110 may include line-head-type inkjet heads (not illustrated) for various colors to be used in printing. The printing unit 110 may use a printing scheme other than the inkjet printing scheme.

The transporter 120 faces the printing unit 110. For example, the transporter 120 may transport a sheet P by means of the transportation belt while attracting the sheet P.

The first paper feeder 131, the second paper feeder 140, and the third paper feeder 152 include paper feeding trays 131, 141, and 151, scraper rollers 132, 142, and 152, and pickup rollers 133, 143, and 153.

A plurality of sheets P are placed on the paper feeding trays 131, 141, and 151.

The scraper rollers 132, 142, and 152 are drawing-out rollers for drawing out and transporting uppermost sheets P among the plurality of sheets P placed on the paper feeding trays 131, 141, and 151.

The pickup rollers 133, 143, and 153 transport the sheets P drawn out by the scraper rollers 132, 142, and 152 to the transportation path R.

The transportation roller pairs 161-165 are disposed on portions of the transportation path R from the first paper feeder 130, the second paper feeder 140, and the third paper feeder 150 to the paper-stop-roller pair 166.

Sheets P transported from the paper feeding apparatus 1, the first paper feeder 130, the second paper feeder 140, and the third paper feeder 150 abut the paper-stop-roller pair 166. Thus, skew of sheets P is corrected.

Sheets P on which the printing unit 110 has performed printing are transported to and placed on an ejected-paper mount (not illustrated).

The following describes a paper feeding operation performed by the paper feeding apparatus 1 by referring to FIGS. 7 and 8A-8D.

Figure 7:
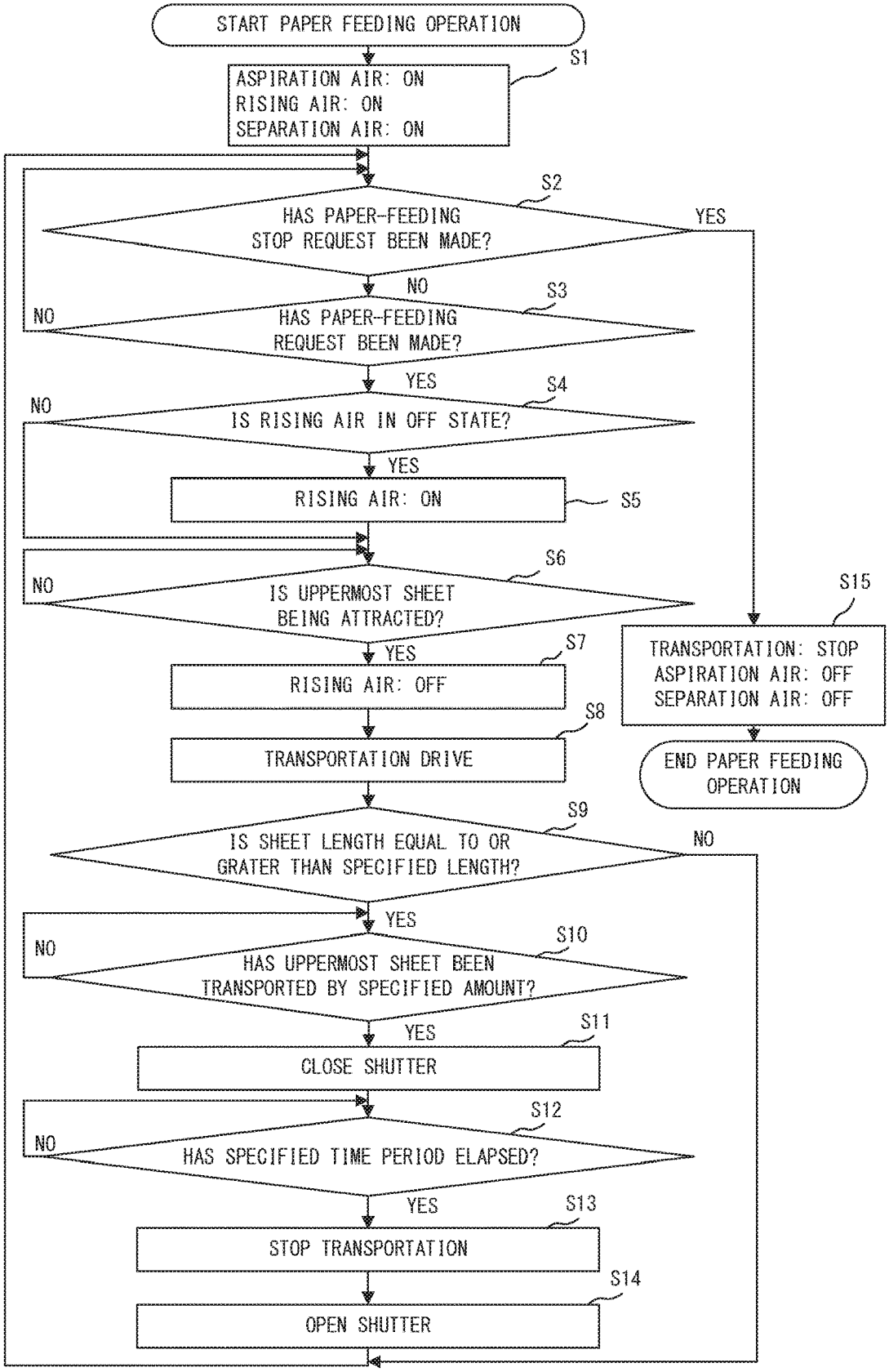
FIG. 7 is a flowchart for illustrating a paper feeding operation in one embodiment.

For example, processes of the flowchart, depicted in FIG. 7 may be performed by the control unit 71 indicated in FIG. 2 upon receipt of a signal for starting the paper feeding operation from the control unit for the printing apparatus 10.

Figure 8A:
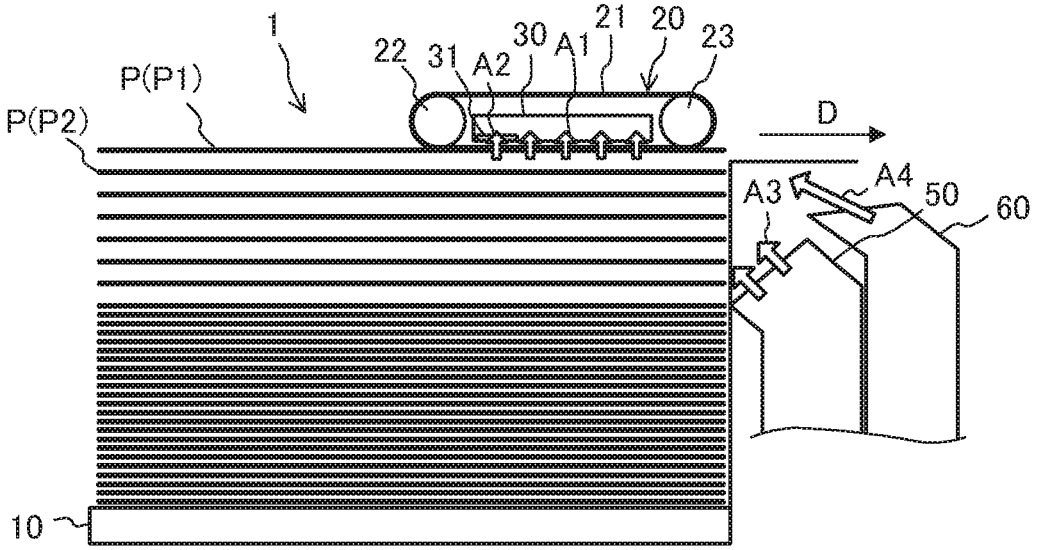
FIG. 8A is an explanatory diagram for a paper feeding operation in one embodiment (example 1)

The control unit 71 causes the aspiration mechanism 30 to start aspiration of the aspiration airs A1 and A2, causes the rising-air blowout mechanism 50 to start the blowing-out of the rising air A3, and causes the separation-air blowout mechanism 60 to start the blowing-out of the separation air A4 (step S1). As depicted in FIG. 8A, the rising-air blowout mechanism 50 blows out the rising air A3 to float about ten sheets P, including an uppermost sheet P1 and a second sheet P2.

The control unit 71 repeatedly determines whether the control unit for the printing apparatus 101 has made a paper-feeding stop request (step S2) or a paper-feeding request (step S3).

When a paper-feeding request is received (step S3: YES), the control unit 71 determines whether the rising-air blowout mechanism 50 is blowing out the rising air A3 (step S4).

When the rising air A3 is being stopped (step S4: YES), the control unit 71 causes the rising-air blowout mechanism 50 to blow out the rising air A3 (step S5).

The control unit 71 determines on the basis of, for example, a time such as a preset transportation timing whether the uppermost sheet P1 is being attracted to the transportation belt 21 in accordance with the aspiration mechanism 30 aspirating the aspiration airs A1 and A2 (step S6).

Figure 8B:
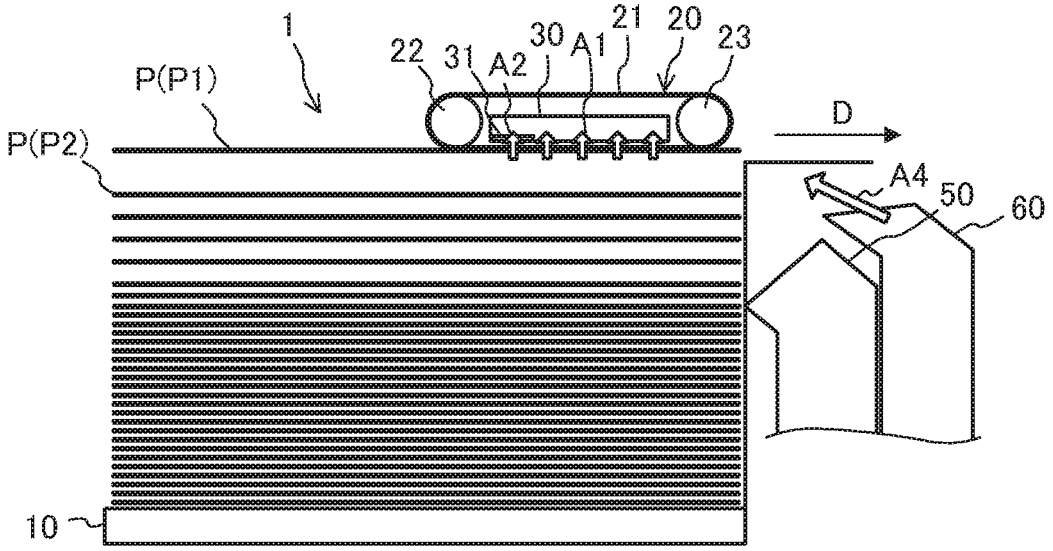
FIG. 8B is an explanatory diagram for a paper feeding operation in one embodiment (example 2)

When determining that the uppermost sheet P1 is being attracted to the transportation belt 21 (step S6: YES), the control unit 71 causes the rising-air blowout mechanism 50 to stop blowing out the rising air A3 (step S7), as depicted in FIG. 8B (step S7). The control unit 71 causes the transportation mechanism 20 to start transportation of the uppermost sheet P1 under drive control performed by the transportation driver 82 (step S8).

Meanwhile, since the separation-air blowout mechanism 60 is blowing out the separation air A4, the uppermost sheet P1 and the second sheet P2 are separated, and only the uppermost sheet P1 is transported downstream in the transportation direction D.

The control unit 71 determines on the basis of sheet information (described hereinafter), i.e., an example of medium information, whether a length of the sheet P in the transportation direction D is equal to or greater than a specified length (step S9).

When the length of the sheet P in the transportation direction P is not equal to or greater than the specified length (step S9: NO), the control unit 71 returns to step S2 and performs the processes again starting from step S2.

Figure 8C:
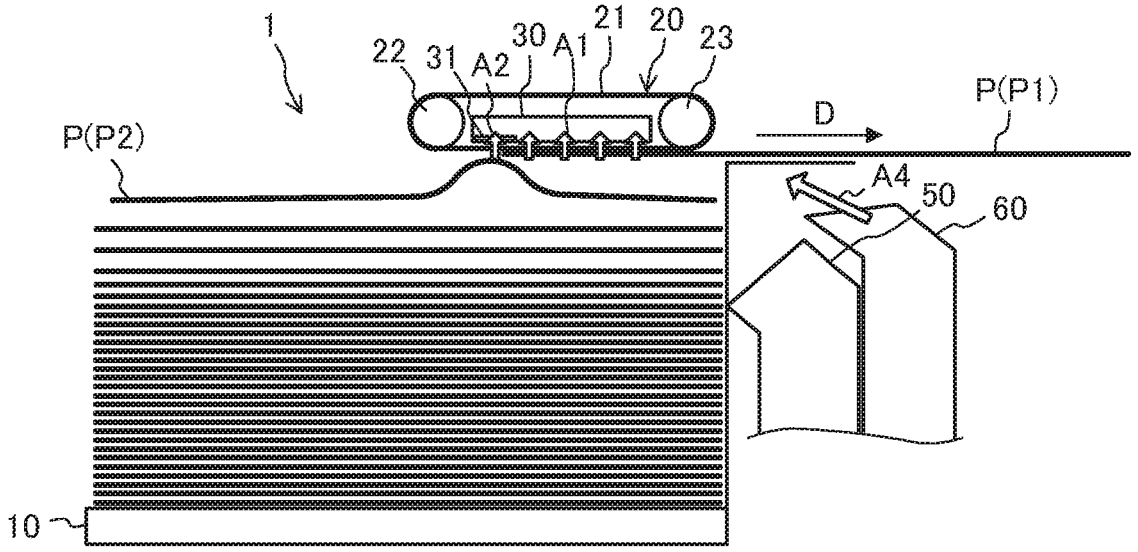
FIG. 8C is an explanatory diagram for a paper feeding operation in one embodiment (example 3)

When the length of the sheet P in the transportation direction P is equal to or greater than the specified length (step S9: YES), the control unit 71 repeatedly determines whether the transportation mechanism 20 has transported the uppermost sheet P1 by a specified amount (step S10). This specified length may be a length up to a point at which the aspiration mechanism 30 (blocking unit 31) faces the second sheet P2 during the process of the uppermost sheet P1 being transported, as depicted in FIG. 8C. If the second sheet P2 is exposed upward in association with the transportation of the uppermost sheet P1 and thus faces the aspiration mechanism 30, the second sheet P2 will be attracted to the transportation belt 21 due to aspiration of the aspiration air A2 at a portion of the aspiration mechanism 30 on the upstream side in the transportation direction D.

Figure 8D:
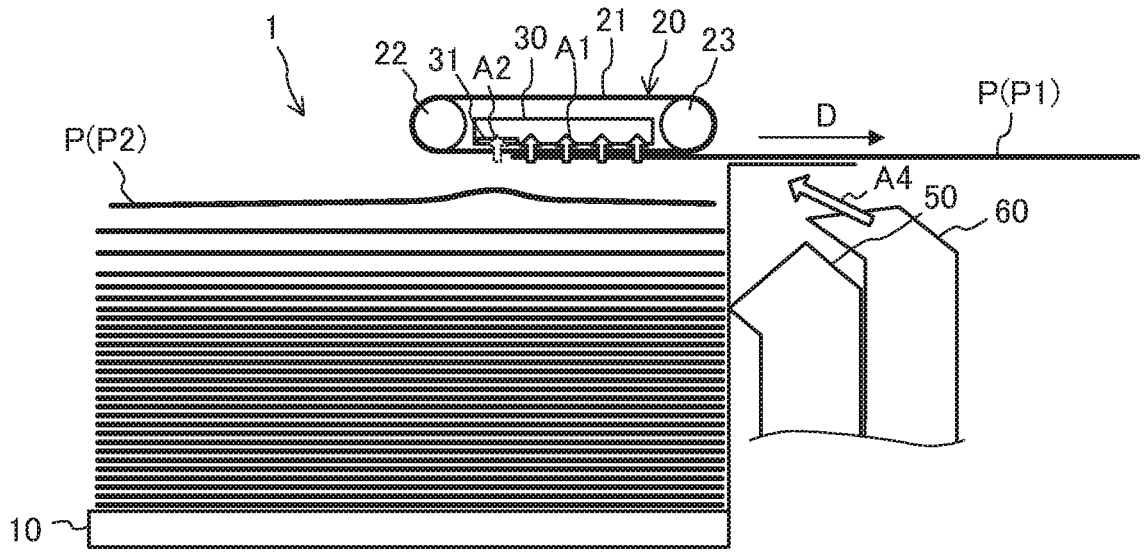
FIG. 8D is an explanatory diagram for a paper feeding operation in one embodiment (example 4)

When the uppermost sheet P1 has been transported by the specified amount by the transportation mechanism 20 (step S10: YES), the control unit 71 closes, during the process of the uppermost sheet P1 being transported by the transportation mechanism 20, the shutter 31*a* of the blocking unit 31 by rotating the shutter 31*a* to the blocking position (1) as depicted in FIG. 4B, thereby blocking the aspiration of the aspiration air A2 for a portion of the aspiration mechanism 30 on the upstream side in the transportation direction D, as depicted in FIG. 8D (step S11). When blocking the aspiration of the aspiration air A2, the shutter 31*a* faces the second sheet P2 and is thus considered to block the aspiration of the aspiration air A2 so as to prevent the second sheet P2 from being attracted to the aspiration mechanism 30. In other words, the shutter 31*a* blocks the aspiration of the aspiration air A2 when the uppermost sheet P1 is no longer attracted as a result of being transported by the transportation mechanism 20.

Although descriptions have been given of an example in which the blocking unit 31 of the aspiration mechanism 30 is used, the blocking unit 41 in the first variation depicted in FIGS. 5A-5C or the blocking unit 91 in the second variation depicted in FIGS. 6A-6D may be used.

Until a specified time period elapses (step S12), the control unit 71 stops the aspiration of the aspiration air A2 by means of the shutter 31*a*. When the specified time period has elapsed (step S12: YES), the control unit 71 stops the driving of the transportation mechanism 20 performed by the transportation driver 82, thereby stopping the transportation (step S13). The control unit 71 opens the shutter 31*a* by rotating the shutter 31*a* to the retracted position (2) where, as depicted in FIG. 4A, this shutter does not block the aspiration of the aspiration air A2 (step S14). Then, the control unit 71 returns to step S2 and performs the processes again starting from step S2.

Upon receipt of a paper-feeding stop request from the control unit for the printing apparatus 101 (step S2: YES), when the transportation performed by the transportation mechanism 20 is continued, the control unit 71 controls the transportation driver 82 so as to stop the transportation mechanism 20 and stops the aspiration of the aspiration airs A1 and A2 performed by the aspiration mechanism 30 and the blowing-out of the separation air A4 performed by the separation-air blowout mechanism 60 (step S15), thereby finishing the processes depicted in FIG. 7.

The determination based on sheet information in step S9 as to whether the length of the sheet P is equal to or greater than a specified length is an example of a determination made by the control unit 71 on the basis of sheet information so as to make at least either an adjustment as to whether the blocking unit 31 is to perform the operation of blocking aspiration of the aspiration air A2 or an adjustment to the area of blocking the aspiration of the aspiration air A2. On the basis of a result of the determination on the length of the sheet P in the transportation direction L (step S9), the control unit 71 makes an adjustment as to whether the blocking unit 31 is to perform the operation of blocking the aspiration of the aspiration air A2 (step S11).

For example, sheet information may be a size, orientation, or type of a sheet P. The sheet information is acquired by, for example, the control unit 71 on the basis of a print job.

For example, the size of a sheet P may be A3 (297×420 mm) or A4 (210×297 mm). The orientation of the sheet P is a vertical orientation wherein a longitudinal direction of the sheet P is parallel to the transportation direction or is a horizontal orientation wherein the longitudinal direction of the sheet P is orthogonal to the transportation direction D. The type of the sheet P may be plain paper, thick paper, or thin paper, and the weight thereof may be expressed in grammage. The control unit 71 can obtain the length of the sheet P in the transportation direction from the size and orientation of the sheet P.

When the length of the sheet P in the transportation direction D is equal to or greater than the specified length (step S9: YES), the second sheet P2 is likely to be attracted to the transportation belt 21 due to the aspiration of the aspiration air A2 at a portion of the aspiration mechanism 30 on the upstream side in the transportation direction D, and thus the control unit 71 causes the blocking unit 31 to perform the operation of blocking the aspiration of the aspiration air A2. When the length of the sheet P in the transportation direction is less than the specified length (step S9: NO), the control unit 71 does not cause the blocking unit 31 to perform the operation of blocking the aspiration of the aspiration air A2.

However, the greater length sheets P have in the transportation direction D, the heavier a second sheet P2 will be, and the second sheet P2 could be less likely to be attracted to the transportation belt 21 by the aspiration by the aspiration mechanism 30. Accordingly, when the length of the sheet P in the transportation direction D is equal to or greater than the specified length, the control unit 71 may not cause the blocking unit 31 to perform the operation of blocking the aspiration of the aspiration air A2; and when the length of the sheet P in the transportation direction is less than the specified length, the control unit 71 may cause the blocking unit 31 to perform the operation of blocking the aspiration of the aspiration air A2.

When sheets P are thick paper, a second sheet P2 could be heavy and thus less likely to be attracted to the transportation belt 21, and accordingly the control unit 71 may not cause the blocking unit 31 to perform the operation of blocking the aspiration of the aspiration air A2. Thus, on the basis of sheet information such as the type of sheets P, the control unit 71 may not cause the blocking unit 31 to perform the operation of blocking the aspiration of the aspiration air A2.

Meanwhile, on the basis of sheet information, the control unit 71 may adjust the area of blocking the aspiration of the aspiration air A2 that is performed by the blocking unit 31. For example, when a sheet P is thick paper with a relatively high grammage in comparison with thin paper with a relatively low grammage, the control unit 71 may increase the area of blocking the aspiration of the aspiration air A2 that performed by the blocking unit 31. Alternatively, on the basis of the size, orientation, or the like of the sheet P, the control unit 71 may adjust the area of blocking the aspiration of the aspiration air A2 that is performed by the blocking unit 31.

On the basis of sheet information, the control unit 71 may adjust the quantity of the rising air A3 from the rising-air blowout mechanism 50 and the quantity of the separation air A4 from the separation-air blowout mechanism 60.

The control unit 71 may acquire, in addition to the above-described sheet information (or instead of the sheet information), environment information such as a humidity or airflow in an environment where the paper feeding apparatus 1 is installed from a sensor (not illustrated) and, on the basis of the environment information, make at least either the adjustment as to whether the blocking unit 31 is to perform the operation of blocking aspiration of the aspiration air A2 or the adjustment to the area of blocking the aspiration of the aspiration air A2. For example, as the humidity becomes lower and as the airflow increases, sheets P may have a less weight and a second sheet P2 may float more easily, with the result that the second sheet P2 will be more easily attracted to the transportation mechanism 20. In accordance with the tendency of the second sheet P2 to be attracted to the transportation mechanism 20, the control unit 71 may make at least either the adjustment as to whether the blocking unit 31 is to perform the operation of blocking aspiration of the aspiration air A2 or the adjustment to the area of blocking the aspiration of the aspiration air A2.

Figure 9:
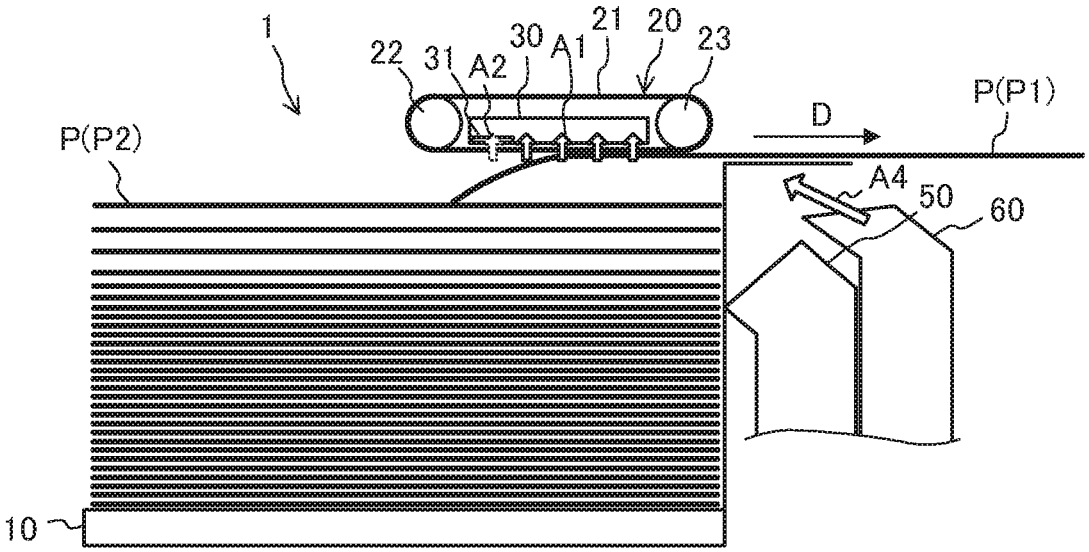
FIG. 9 is an explanatory diagram for a paper feeding operation in a third variation of one embodiment.

FIG. 9 is an explanatory diagram for a paper feeding operation in a third variation of the present embodiment.

In the examples described above, during the process of the uppermost sheet P1 being transported by the transportation mechanism 20, the blocking unit 31 blocks the aspiration of the aspiration air A2 while facing the second sheet P2 exposed upward in association with the transportation of the uppermost sheet P1, as depicted in FIG. 8D.

However, the blocking unit 31 may block the aspiration of the aspiration air A2 while facing the uppermost sheet P1 so that an attracted state of at least a portion of the uppermost sheet P1 on the upstream side in the transportation direction D (upstream side of the center in the transportation direction D) can be eliminated, as depicted in FIG. 9. Making at least a portion of the uppermost sheet P1 no longer attracted to the transportation mechanism 20 like this causes this portion of the uppermost sheet P1 to droop down below the attraction surface (bottom surface) of the transportation belt 20, thereby pressing the second sheet P2 downward. Hence, the second sheet P2 can be prevented from being attracted to the transportation mechanism 20 by the aspiration of the aspiration air A2 performed by the aspiration mechanism 30. Also in this case, the control unit 71 is considered to block the aspiration of the aspiration air A2 by means of the blocking unit 31 so as to prevent the second sheet P2 from being attracted to the transportation mechanism 20 during the process of the uppermost sheet P1 being transmitted by the transportation mechanism 20.

After starting to block the aspiration of the aspiration air A2 while facing the uppermost sheet P1, the blocking unit 31 may continue to block the aspiration of the aspiration air A2 until the blocking unit 31 faces the second sheet P2.

In the present embodiment described so far, the paper feeding apparatus 1, i.e., an example of the medium supply apparatus, includes: the placement mount 10 on which a plurality of sheets P, i.e., examples of a plurality of media, are placed; the transportation mechanism 20 that transports an uppermost sheet P1 of the plurality of sheets P placed on the placement mount 10; and the aspiration mechanism 30 that aspirates aspiration airs A1 and A2 to attract the uppermost sheet P1 to the transportation mechanism 20, wherein the aspiration mechanism 30 includes the blocking unit 31 (an example of the blocking means) for blocking aspiration of the aspiration air A2 for a portion of the aspiration mechanism 30 on the upstream side in the transportation direction D in which the uppermost sheet P1 is transported by the transportation mechanism 20. For example, the blocking unit 31 may block the aspiration of the aspiration air A2 performed by the aspiration mechanism 30 when the uppermost sheet P1 is no longer attracted as a result of being transported by the transportation mechanism 20.

Accordingly, the operation of blocking the aspiration of the aspiration air A2 that is performed by the blocking unit 31 can reduce the occurrence of situations in which during the process of an uppermost sheet P1 being transported by the transportation mechanism 20, a second sheet P2 is exposed upward in association with the transportation of the uppermost sheet P1 and attracted to the transportation mechanism 20 due to the aspiration mechanism 30 aspirating the aspiration air A2. Thus, the present embodiment can reduce the occurrence of situations in which the second sheet P2 placed on the placement mount 10 is transported by the transportation mechanism 20 together with the uppermost sheet P1. Hence, the second sheet P2 can be prevented from being transported by the transportation mechanism 20 together with the uppermost sheet P1, and a leading edge of the second sheet P2 in the transportation direction D2 can be prevented from knocking against the wall surface of the placement mount 10, with the result that a folded paper-portion will not be provided.

In the present embodiment, the control unit 71 that controls the blocking unit 31 makes, on the basis of sheet information (an example of the medium information) of a plurality of sheets P placed on the placement mount 10, at least either an adjustment as to whether the blocking unit 31 is to perform the operation of blocking aspiration of the aspiration air A2 or an adjustment to the area of blocking the aspiration of the aspiration air A2. Accordingly, control can be performed in consideration of the tendency of the second sheet P2 to be attracted to the transportation mechanism 20 that is associated with the size, orientation, type, or the like of the sheet P, thereby more reliably reducing the occurrence of situations in which the second sheet P2 is attracted to the transportation mechanism 20.

In the present embodiment and the first and second variations, the blocking units 31, 41, and 91 include the shutters 31*a*, 41*b*, 41*c*, 91*a*, 91*b*, and 91*c* which move to the blocking positions (1) where these shutters block the aspiration of the aspiration air A2 and the retracted positions (2) retracted from the blocking positions. Accordingly, with the simple configurations in which the shutters 31*a*, 41*b*, 41*c*, 91*a*, 91*b*, and 91*c* are moved, it is possible to reduce the occurrence of situations in which the second sheet P2 is attracted to the transportation mechanism 20.

In accordance with the transportation of the uppermost sheet P1 (an example of the uppermost medium), the blocking unit 31 (an example of the blocking means) increases the area of blocking the aspiration of aspiration air A2 performed by the aspiration mechanism 30. In the first and second variations of the present embodiment respectively depicted in FIGS. 5A-5C and FIGS. 6A-6D, for example, the control unit 71 which controls the shutters 41*b* and 41*c* or the shutters 91*a*, 91*b*, and 91*c* may control the positions of the shutters 41*b* and 41*c* or the shutters 91*a*, 91*b*, and 91*c* in a manner such that the area of blocking the aspiration of the aspiration air A2 is increased toward the downstream side in the transportation direction D in accordance with the transportation of the uppermost sheet P1. Thus, the area of blocking can be increased with an increase in the area of the upward exposure of the second sheet P2 that occurs in association with the uppermost sheet P1 being transported downstream in the transportation direction D. Accordingly, it is possible to more reliably reduce the occurrence of situations in which the second sheet P2 is attracted to the transportation mechanism 20.

In the present embodiment, during the process of the uppermost sheet P1 being transported by the transportation mechanism 20, the control unit 71 which controls the blocking unit 31 causes the blocking unit 31 to block the aspiration of the aspiration air A2 while facing the second sheet P2 (an example of another medium) exposed upward in association with the transportation of the uppermost sheet P1. Accordingly, the second sheet P2 can be prevented from being directly aspirated by the aspiration air A2, thereby more reliably reducing the occurrence of situations in which the second sheet P2 is attracted to the transportation mechanism 20.

In the third variation of the present embodiment which is indicated in FIG. 9, the control unit 71 which controls the blocking unit 31 causes the blocking unit 31 to block the aspiration of the aspiration air A2 while facing the uppermost sheet P1 in a manner such that a portion of the uppermost sheet P1 on the upstream side in the transportation direction D is no longer attracted to the transportation mechanism 20. Making at least a portion of the uppermost sheet P1 on the upstream side in the transportation direction D no longer attracted to the transportation mechanism 20 in this way causes this portion of the uppermost sheet P1 on the upstream side in the transportation direction D to be located below the attraction surface of the transportation mechanism 20, with the result that the second sheet P2 is pressed downward by the uppermost sheet P1 and thus can be prevented from being attracted to the transportation mechanism 20. In addition, the second sheet P2 can be prevented from being attracted to the transportation mechanism 20 at a timing at which the second sheet P2 faces the aspiration mechanism 30 as a result of being exposed upward in association with the transportation of the uppermost sheet P1. Furthermore, the timing at which the second sheet P2 faces the blocking unit 31 (aspiration mechanism 30) as a result of being exposed upward does not need to be exactly figured out, so that the occurrence of situations in which the second sheet P2 is attracted to the transportation mechanism 20 can be reduced more reliably through simple control.

In the present embodiment, the aspiration mechanism 30 is considered to include the blocking unit 31 (an example of the blocking means) that blocks the aspiration of the aspiration air A2 performed by the aspiration mechanism 30, in such a manner as to prevent a second sheet P2 (an example of another medium) located below the uppermost sheet P1 from being attracted to the transportation mechanism 20. Thus, the operation of blocking the aspiration of the aspiration air A2 that is performed by the blocking unit 31 can reduce the occurrence of situations in which during the process of an uppermost sheet P1 being transported by the transportation mechanism 20, a second sheet P2 is exposed upward in association with the transportation of the uppermost sheet P1 and attracted to the transportation mechanism 20 due to the aspiration mechanism 30 aspirating the aspiration air A2. Hence, the present embodiment can reduce the occurrence of situations in which the second sheet P2 placed on the placement mount 10 is transported by the transportation mechanism 20 together with the uppermost sheet P1. Therefore, the second sheet P2 can be prevented from being transported by the transportation mechanism 20 together with the uppermost sheet P1, and a leading edge of the second sheet P2 in the transportation direction D2 can be prevented from knocking against the wall surface of the placement mount 10, with the result that a folded paper-portion will not be provided.

In the present embodiment, after the uppermost sheet P1 is attracted to the transportation mechanism 20 and starts to be transported (step S8), the blocking unit 31, i.e., an example of the blocking means, is considered to block the aspiration of the air A2 performed by the aspiration mechanism 30 during a portion of the period (steps S11-S13) from the moment at which the uppermost sheet P1 transported by the transportation mechanism 20 starts to face the aspiration mechanism 30 to the moment at which the uppermost sheet P1 comes to no longer face the aspiration mechanism 30. Thus, the operation of blocking the aspiration of the aspiration air A2 that is performed by the blocking unit 31 can reduce the occurrence of situations in which during the process of an uppermost sheet P1 being transported by the transportation mechanism 20, a second sheet P2 is exposed upward in association with the transportation of the uppermost sheet P1 and attracted to the transportation mechanism 20 due to the aspiration mechanism 30 aspirating the aspiration air A2. In addition, the transportation mechanism 20 transports the uppermost sheet P1 during at least a portion of the period in which the blocking unit 31 blocks the aspiration of the aspiration air A2 performed by the aspiration mechanism 30, thereby reducing the occurrence of situations in which the uppermost sheet P1 is scraped against the transportation mechanism 20 and ultimately reducing deterioration of the transportation mechanism 20 and a transportation jam that could occur due to transportation resistance, in comparison with an aspect in which the transportation mechanism 20 stops during the process of the uppermost sheet P1 being transported. In addition, when, for example, the uppermost sheet P1 has already undergone a printing process, the printing surface can be prevented from being stained due to being scraped against the transportation mechanism 20. Moreover, the blocking unit 31 blocks the aspiration of the aspiration air A2 performed by the aspiration mechanism 30, thereby reducing the occurrence of situations in which the second sheet P2 is transported together with the uppermost sheet P1.

In the embodiment described above, the aspiration mechanism 30 includes the blocking unit 31 (an example of the blocking means) for blocking aspiration of the aspiration air A2 for a portion of the aspiration member 30 located on the upstream side in the transportation direction D. However, the blocking means (blocking unit) may block the aspiration of the aspiration airs A1 for the entire area in the transportation direction D. Such a blocking means (blocking unit) for blocking the aspiration of the aspiration airs A1 for the entire area in the transportation direction D and other components are described in the following by referring to another embodiment.

Another Embodiment

Figure 11:
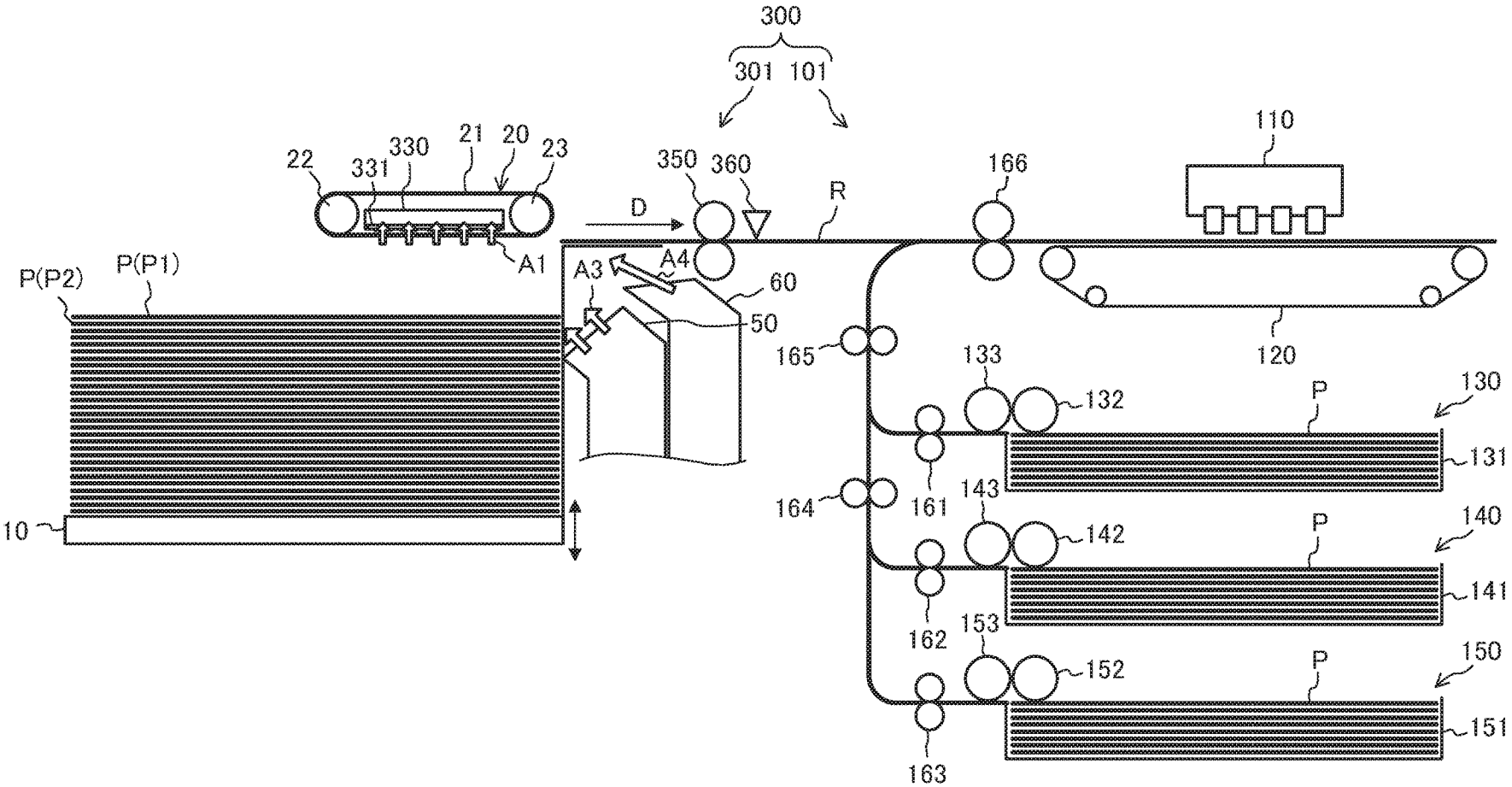
FIG. 11 is a configuration diagram illustrating a printing system that includes a paper feeding apparatus in accordance with another embodiment.

FIG. 11 is a configuration diagram illustrating a printing system 300 that includes a paper feeding apparatus 301 in accordance with another embodiment.

Figure 12:
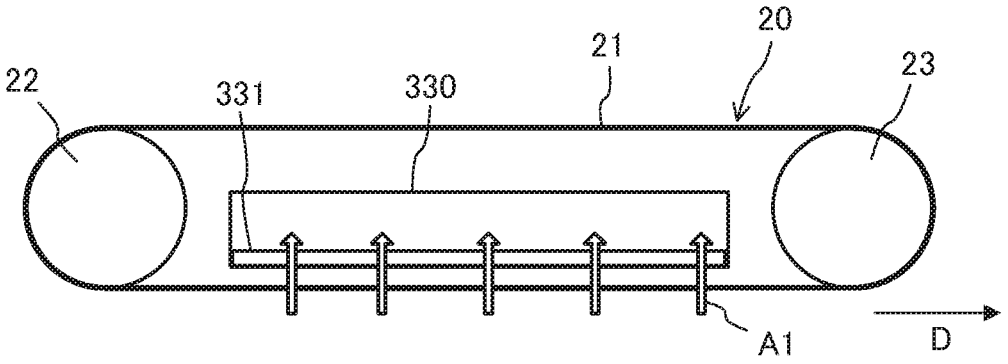
FIG. 12 is an enlarged view illustrating a transportation mechanism and an aspiration mechanism in another embodiment.

FIG. 12 is an enlarged view illustrating a transportation mechanism 20 and an aspiration mechanism 330.

The printing system 300 depicted in FIG. 11 includes the paper feeding apparatus 301 and the printing apparatus 101.

In comparison with the paper feeding apparatus 1 depicted in FIG. 1, the paper feeding apparatus 300 in the present embodiment includes a blocking unit (an example of the blocking means) that blocks the aspiration of the aspiration airs A1 for the entire area in the transportation direction D, instead of the blocking unit 31 that blocks the aspiration of the aspiration airs A1 for a portion (only a portion) of the aspiration mechanism on the upstream side in the transportation direction D. The paper feeding apparatus 301 further includes a transportation roller pair 350 (an example of a downstream-side transportation mechanism) and a sheet sensor 360. Aside from these components, the present embodiment may be similar to the matters described above with reference to the above-described one embodiment (including the first to third variations). Accordingly, detailed descriptions of the present embodiment are omitted herein. Note that the transportation roller pair 350 and the sheet sensor 360 may be disposed in the paper feeding apparatus 1 in accordance with the above-described one embodiment.

As depicted in FIG. 12, the aspiration mechanism 330 includes a blocking unit 331 that blocks aspiration of the aspiration airs A1 for the entirety of the aspiration member 330 in the transportation direction D. The blocking unit 311 is an example of the blocking means. For example, the blocking unit 311 may be disposed on an inner bottom surface of the aspiration mechanism 330 (inside a chamber). Alternatively, the blocking unit 331 may be disposed on an outer bottom surface of the aspiration mechanism 330 (outside the chamber).

For example, the blocking unit 331 may be: a blocking unit 31 that includes the shutter 31*a* and other components as depicted in FIGS. 4A and 4B and has a size such that the aspiration of the aspiration airs A1 is blocked for the entire area in the transportation direction D; a plurality of blocking units 31 arranged in the transportation direction D; a blocking unit 41 that includes a plurality of shutters moved in the transportation direction D to a retracted position or a blocking position, as seen in the first variation depicted in FIGS. 5A-5C; or a blocking unit 91 that includes a plurality of shutters rotated (moved) to a retracted position or a blocking position, as seen in FIGS. 6A-6D. Alternatively, the blocking unit 331 may be a blocking unit that can be spooled or unspooled and moved from a retracted position to a blocking position or a drive circuit for stopping the driving of an aspirator aspirating the aspiration airs A1. Thus, the configuration of the blocking unit 331 is not particularly limited.

The transportation roller pair 350 depicted in FIG. 11 is an example of a downstream-side transportation mechanism located downstream from the transportation mechanism 20 in the transportation direction D and nips and transports an uppermost sheet P1.

The sheet sensor 360 is located downstream from the transportation roller pair 350 in the transportation direction D. The sheet sensor 360 is an example of a medium sensor for sensing the presence/absence of a sheet P.

The following describes a paper feeding operation performed by the paper feeding apparatus 301 by referring to FIGS. 13, 14, and 15A-15C.

Figure 13:
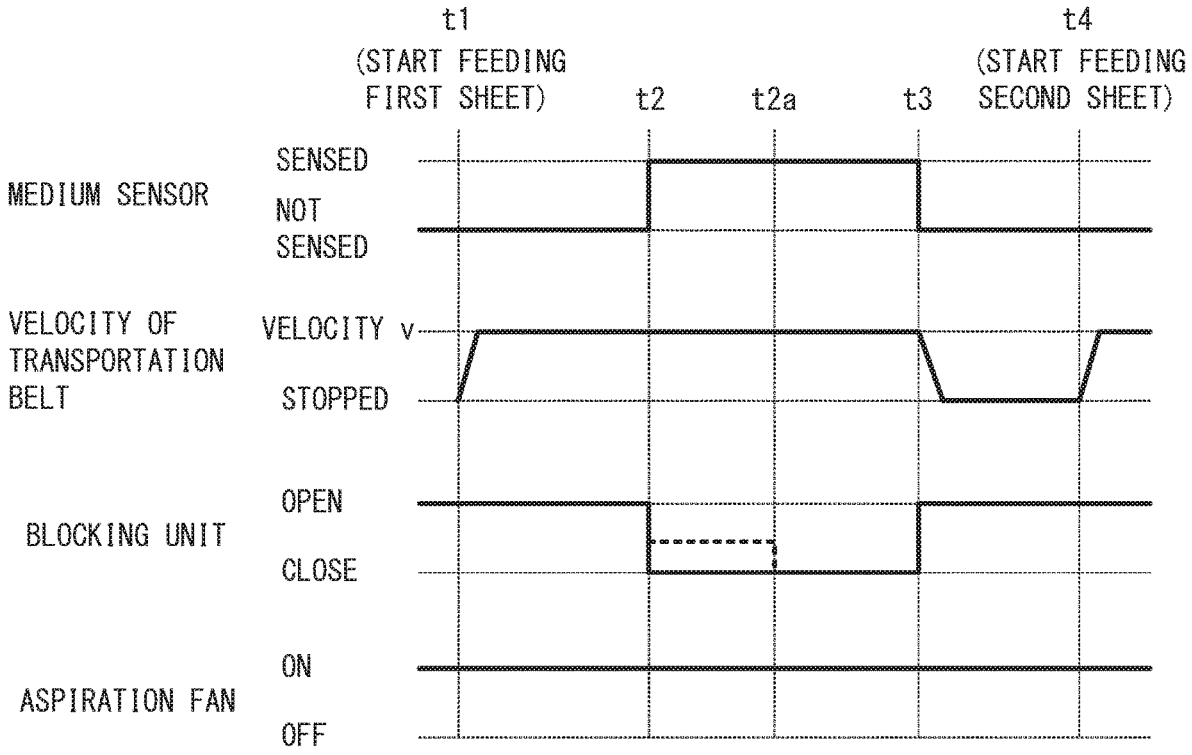
FIG. 13 is a timing chart for illustrating a paper feeding operation in another embodiment.

FIG. 13 is a timing chart for illustrating a paper feeding operation in another embodiment.

Figure 14:
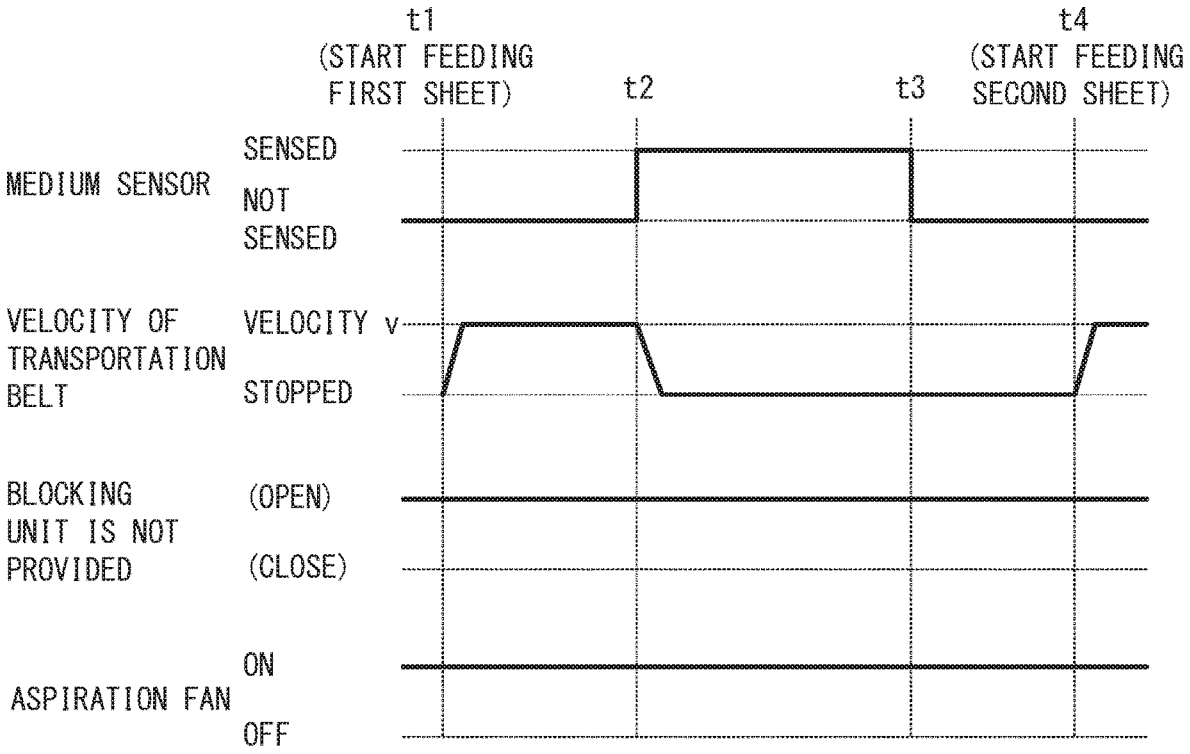
FIG. 14 is a timing chart for illustrating a paper feeding operation in a comparative example.

FIG. 14 is a timing chart for illustrating a paper feeding operation in a comparative example.

Figure 15A:
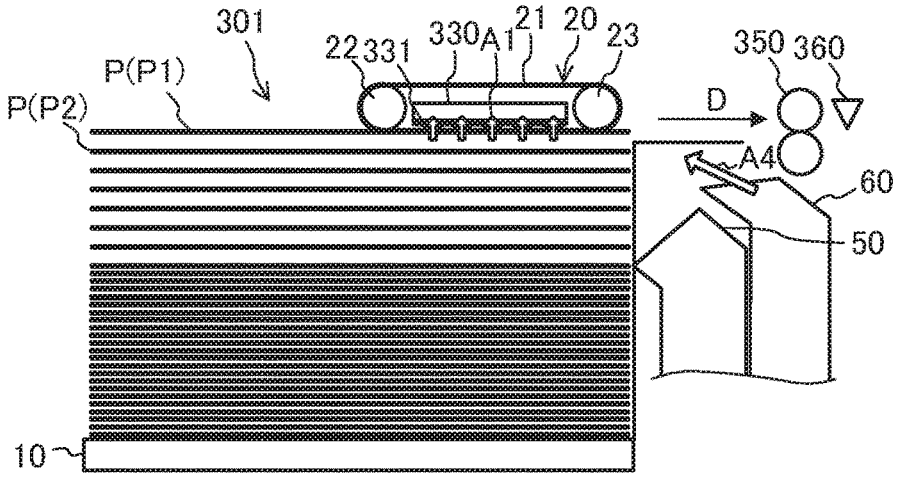
FIG. 15A is an explanatory diagram for a paper feeding operation in another embodiment (example 1)
Figure 15B:
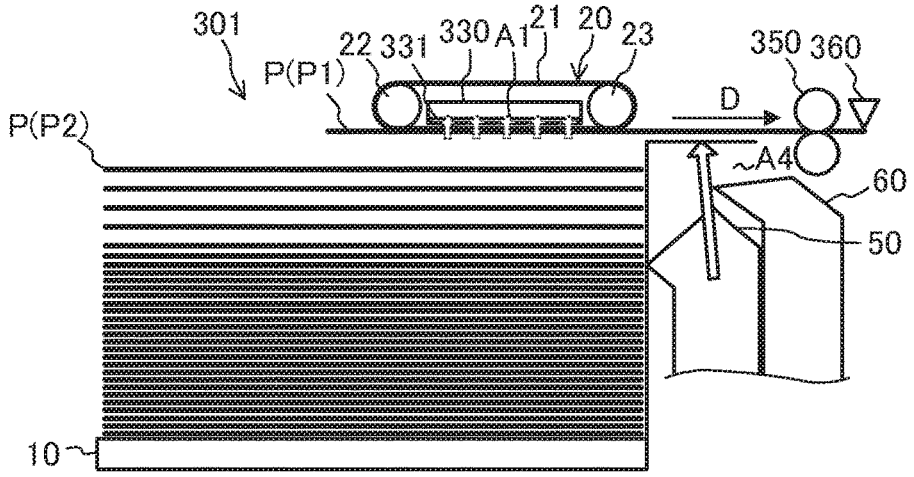
FIG. 15B is an explanatory diagram for a paper feeding operation in another embodiment (example 2)
Figure 15C:
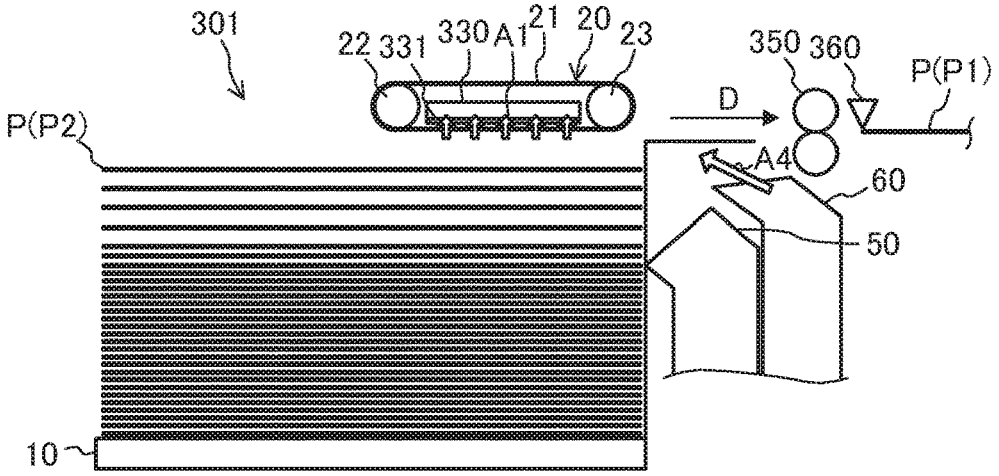
FIG. 15C is an explanatory diagram for a paper feeding operation in another embodiment (example 3).

FIGS. 15A-15C are explanatory diagrams for a paper feeding operation in another embodiment. For example, processes of the timing chart indicated in FIG. 13 may be performed by the control unit 71 depicted in FIG. 2.

At a timing at which, as in the process of step S8 of the flowchart depicted in FIG. 7, an uppermost sheet P1 starts to be transported by the transportation mechanism 20 under drive control performed by the transportation driver 82 depicted in FIG. 2, the control unit 71 starts the transportation of the uppermost sheet P1 (time t1), as seen in FIG. 13.

At time t1, as indicated in FIG. 15A, the sheet sensor 360 does not sense the uppermost sheet P1, and the blocking unit 331 is located at a retracted position (OPEN position) where the blocking unit 331 does not block the aspiration of the aspiration air A. An aspiration fan (not illustrated), i.e., an example of an aspirator, is continuously operated (ON). The rising-air blowout mechanism 50 is not blowing out the rising air A3, and the separation-air blowout mechanism 60 is blowing out the separation air A4.

Then, when a leading edge of the uppermost sheet P1 in the transportation direction D has reached the sheet sensor 360 as depicted in FIG. 15B, the sheet sensor 360 senses the uppermost sheet P1 (time t2). Upon the sheet sensor 360 sensing the uppermost sheet P1, the control unit 71 moves the blocking unit 331 to a blocking position (CLOSE position) where the blocking unit 331 blocks the aspiration of the aspiration airs A1. In FIG. 15B, dashed arrows indicate an aspiration airs A1 with aspiration blocked.

The timing at which the blocking unit 331 is moved to the blocking position is not limited to time t2 but may be any timing, e.g., a timing before or when the aspiration mechanism 330 (blocking unit 331) faces a second sheet P2 during the process of the uppermost sheet P1 being transported, or may be a specified time before or after time t2. The timing at which the aspiration mechanism 330 comes to face the second sheet P2 can be determined on the basis of a timing at which the sheet sensor 360 senses the position of the leading edge of the uppermost sheet P1 in the transportation direction D, the transportation velocity of the uppermost sheet P1, a result of a size sensor (not illustrated) sensing the size of the sheet P (the length of the sheet P in the transportation direction D), or the like. When the transportation roller pair 350 nips the uppermost sheet P1, the uppermost sheet P1 is transported even without being attracted to the transportation mechanism 20, and hence the blocking unit 331 may be moved to the blocking position after the transportation roller pair 350 starts to nip the uppermost sheet P1. The sheet sensor 360 may be disposed in the vicinity of the aspiration mechanism 330 (e.g., at a position upstream from the aspiration mechanism 330 in the transportation direction D) so that passage of a rear edge of the uppermost sheet P1 can be sensed.

Then, when the rear edge of the uppermost sheet P1 in the transportation direction D has passed by the sheet sensor 360 as depicted in FIG. 15C, the sheet sensor 360 no longer senses the uppermost sheet P1 (time t3). Upon the uppermost sheet P1 coming to be no longer sensed by the sheet sensor 360, the control unit 71 moves the blocking unit 331 to a retracted position (OPEN position) where the blocking unit 331 does not block the aspiration of the aspiration airs A1. Meanwhile, the control unit 71 stops the transportation of the uppermost sheet P1 performed by the transportation mechanism 20.

The timing at which the blocking unit 331 is moved to the retracted position is not limited to time t3 but may be, for example, a time after the uppermost sheet P1 has come to no longer face the aspiration mechanism 30. The timing at which the blocking unit 331 is moved to the blocking position is time t2, which follows the start of transportation. Thus, the blocking unit 331 is considered to block the aspiration of the aspiration airs A1 performed by the aspiration mechanism 330 during the period from time t2, i.e., a time after the uppermost sheet P1 is attracted to the transportation mechanism 20 and starts to be transported, to a time at which the uppermost sheet P1 comes to no longer face the aspiration mechanism 30. However, as indicated above with reference to the above-described one embodiment, after the uppermost sheet P1 is attracted to the transportation mechanism 20 and starts to be transported, the blocking unit 331 may block the aspiration of the aspiration airs A1 performed by the aspiration mechanism 330 during a portion of the period from the moment at which the uppermost sheet P1 starts to face the aspiration mechanism 330 to the moment at which the uppermost sheet P1 comes to no longer face the aspiration mechanism 330.

The transportation mechanism 20 transports the uppermost sheet P1 during at least a portion (all periods in the example in FIG. 13) of the period (time t2 to time t3) in which the blocking unit 331 blocks the aspiration of the aspiration airs A1 performed by the aspiration mechanism 330.

Then, the control unit 71 starts the feeding of the second sheet P2 (time t4) in the same manner as the start of feeding of the uppermost sheet P1 (time t1).

During a period (time t2 to time t3) in which the sheet sensor 360 senses the uppermost sheet P1, the control unit 71 may move (time t2) the blocking unit 331 from the retracted position (OPEN position) at which the blocking unit 331 does not block the aspiration of the aspiration airs A1 to a partial blocking position (Half-OPEN position) indicated by a dashed line in FIG. 13 at which the blocking unit 331 blocks a portion of the aspiration of the aspiration airs A1, instead of to the blocking position (CLOSE position) at which the blocking unit 331 blocks the aspiration of the aspiration airs A1, and then the control unit 71 may move (time t2*a*) the blocking unit 331 to the blocking position (CLOSE position) at which the blocking unit 331 blocks the aspiration of the entirety of the aspiration airs A1. In this way, in accordance with the transportation of the uppermost sheet P1, the blocking unit 331 may increase the area of blocking the aspiration of the airs A1 performed by the aspiration mechanism 330. The blocking area may be intermittently increased in the order of, for example, 80% OPEN, 50% OPEN, 20% OPEN, and the blocking position (CLOSE position) or may be gradually increased, i.e., continuously increased. The transportation driver 82 depicted in FIG. 2 may include a solenoid that moves the shutter to the blocking position when the solenoid is energized and a biasing member such as a spring that returns the shutter to the retracted position when the solenoid is not energized. Alternatively, the transportation driver 82 may include a motor and a sensor or encoder or the like for controlling the stop position so as to increase the blocking area as described above. During the period from time t2 to time t3, the blocking unit 331 may be moved to the partial blocking position (HALF-OPEN position), not the blocking position (CLOSE).

As indicated above with reference to the above-described one embodiment, the blocking area and whether the blocking unit 331 is to perform the operation of blocking the aspiration airs A1 may be determined on the basis of sheet information, environment information, or the like.

In the comparative example depicted in FIG. 14, the blocking unit 331 is not provided, and thus the aspiration of the aspiration airs A1 performed by the aspiration mechanism 300 is not blocked while the sheet sensor 360 senses a sheet P (time t2 to time t3). In the comparative example depicted in FIG. 14, the aspiration of the aspiration airs A1 performed by the aspiration mechanism 330 is not blocked, and thus after the sheet sensor 360 has sensed a sheet P (time t2), the transporting operation performed by the transportation mechanism 20 is stopped to prevent the second sheet P2 from being transported together with the uppermost sheet P1. In the comparative example, accordingly, the uppermost sheet P1 could be scraped against the transportation mechanism 20, and ultimately the transportation mechanism 20 could be deteriorated and a transportation jam could occur due to transportation resistance. In addition, when, for example, the uppermost sheet P1 has already undergone a printing process, the printing surface could be stained due to being scraped against the transportation mechanism 20.

The present embodiment achieves similar effects for similar matters in the above-described one embodiment, e.g., achieves the effect of reducing the occurrence of situations in which the second sheet P2 placed on the placement mount 10 is transported by the transportation mechanism 20 together with the uppermost sheet P1.

In the present embodiment, in accordance with the transportation of the uppermost sheet P1 (an example of the uppermost medium), the blocking unit 331 (an example of the blocking means) increases the area of blocking the aspiration of the aspiration airs A1 performed by the aspiration mechanism 330. For example, the control unit 71 may move (time t2) the blocking unit 331 to the partial blocking position (Half-OPEN position) indicated by a dashed line in FIG. 13 at which the blocking unit 331 blocks a portion of the aspiration of the aspiration airs A1, and then the control unit 71 may move (time t2*a*) the blocking unit 331 to the blocking position (CLOSE position) at which the blocking unit 331 blocks the aspiration of the entirety of the aspiration airs A1. Thus, the area of blocking can be increased in accordance with an increase in the area of the upward exposure of the second sheet P2 that occurs in association with the uppermost sheet P1 being transported downstream in the transportation direction D. Accordingly, it is possible to more reliably reduce the occurrence of situations in which the second sheet P2 is attracted to the transportation mechanism 20.

The present invention is not simply limited to the embodiments described herein. Components of the embodiments may be embodied in a varied manner in an implementation phase without departing from the gist of the invention. A plurality of components disclosed with reference to the described embodiments may be combined, as appropriate, to achieve various inventions. For example, all of the components indicated with reference to embodiments may be combined as appropriate. Accordingly, various variations and applications can be provided, as a matter of course, without departing from the gist of the invention. The following indicates, as appendixes, the inventions recited in the claims of the Japanese application as originally filed.

Appendix 1. A medium supply apparatus comprising:

a placement mount on which a plurality of media are placed;

a transportation mechanism that transports an uppermost medium of the plurality of media placed on the placement mount; and an aspiration mechanism that aspirates air to attract the uppermost medium to the transportation mechanism, wherein the aspiration mechanism includes a blocking means for blocking air aspiration for a portion of the aspiration mechanism on an upstream side in a transportation direction in which the uppermost medium is transported by the transportation mechanism.

Appendix 2. The medium supply apparatus of appendix 1, wherein the blocking means blocks air aspiration performed by the aspiration mechanism when the uppermost medium is no longer attracted as a result of being transported by the transportation mechanism.

Appendix 3. The medium supply apparatus of claim 1 or 2, further comprising:

a control unit that controls the blocking means, wherein the control unit makes, on the basis of medium information of the plurality of media placed on the placement mount, at least either an adjustment as to whether the blocking means is to perform an operation of blocking air aspiration or an adjustment to an area of blocking the air aspiration.

Appendix 4. The medium supply apparatus of appendix 1 or 2, wherein the blocking means includes a shutter that moves to a blocking position where the shutter blocks air aspiration and a retracted position retracted from the blocking position.

Appendix 5. The medium supply apparatus of claim 4, further comprising:

a control unit that controls the shutter, wherein the control unit controls a position of the shutter in a manner such that an area of blocking the air aspiration is increased toward a downstream side in the transportation direction in accordance with transportation of the uppermost medium.

What is claimed is:

1. A medium supply apparatus comprising:

a placement mount on which a plurality of media are placed;

a transportation mechanism that transports an uppermost medium of the plurality of media placed on the placement mount, the transportation mechanism including a plurality of through holes facing the plurality of media and through which air is aspirated, and which attract the uppermost medium when all of the through holes are unblocked, and when fewer than all of the though holes are unblocked, the unblocked through holes attract the uppermost medium; and an aspiration mechanism that aspirates air to attract the uppermost medium to the transportation mechanism, wherein the aspiration mechanism includes a shutter blocking the passage of air through one of the through holes thereby blocking air aspiration performed by the aspiration mechanism, in such a manner as to prevent another medium of the plurality of media that is located below the uppermost medium from being attracted to the transportation mechanism, while the aspirating mechanism aspirates air through the other through holes not blocked by the shutter to attract the uppermost medium to the transportation mechanism.

2. The medium supply apparatus of claim 1, wherein after the uppermost medium is attracted to the transportation mechanism and starts to be transported, the shutter blocks the air aspiration performed by the aspiration mechanism during a portion of a period from a moment at which the uppermost medium transported by the transportation mechanism starts to face the aspiration mechanism to a moment at which the uppermost medium comes to no longer face the aspiration mechanism.

3. The medium supply apparatus of claim 1, wherein in accordance with transportation of the uppermost medium, the shutter increases an area of blocking the air aspiration performed by the aspiration mechanism.

4. The medium supply apparatus of claim 1, wherein the shutter blocks air aspiration for a portion of an area on an upstream side in a transportation direction in which the uppermost medium is transported by the transportation mechanism.

5. The medium supply apparatus of claim 1, wherein the shutter blocks the air aspiration performed by the aspiration mechanism when the uppermost medium is no longer attracted as a result of being transported by the transportation mechanism.

6. The medium supply apparatus of claim 1, further comprising:

a control unit that controls the shutter, wherein the control unit makes, on the basis of medium information of the plurality of media placed on the placement mount, at least either an adjustment as to whether the shutter is to perform an operation of blocking air aspiration or an adjustment to an area of blocking the air aspiration.

7. The medium supply apparatus of claim 1, wherein the shutter moves to a blocking position where the shutter blocks air aspiration and a retracted position retracted from the blocking position.

8. The medium supply apparatus of claim 7, further comprising:

a control unit that controls the shutter, wherein the control unit controls a position of the shutter in a manner such that an area of blocking the air aspiration is increased toward a downstream side in the transportation direction in accordance with transportation of the uppermost medium.

9. A medium supply apparatus comprising:

a placement mount on which a plurality of media are placed;

a transportation mechanism that transports an uppermost medium of the plurality of media placed on the placement mount; and an aspiration mechanism that aspirates air to attract the uppermost medium to the transportation mechanism, the aspiration mechanism comprising an aspiration area facing the transportation mechanism and facing the plurality of media on the placement mount and through which air is aspirated through the transportation mechanism to attract the uppermost medium to the transportation mechanism, wherein the aspiration mechanism includes a shutter movable between a blocking position to block air from flowing through a portion of the aspiration area denoted as a blocked portion of the aspiration area, while leaving an unblocked aspiration area not blocked by the shutter, and an open position at which the shutter does not block air from flowing through the aspiration area so that the aspiration area attracts the uppermost medium, and wherein when the shutter is in the blocking position, the unblocked aspiration area attracts the uppermost medium to the transportation mechanism, and the blocked portion of the aspiration area blocked by the shutter prevents another medium of the plurality of media that is located below the uppermost medium from being attracted to the transportation mechanism.

* * * * *